US011668179B2

(12) United States Patent
Hohl et al.

(10) Patent No.: US 11,668,179 B2
(45) Date of Patent: Jun. 6, 2023

(54) DRILLING EVALUATION BASED ON COUPLED TORSIONAL VIBRATIONS

(71) Applicants: Andreas Hohl, Hannover (DE); Vincent Kulke, Braunschweig (DE)

(72) Inventors: Andreas Hohl, Hannover (DE); Vincent Kulke, Braunschweig (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 156 days.

(21) Appl. No.: 17/186,689

(22) Filed: Feb. 26, 2021

(65) Prior Publication Data

US 2021/0270120 A1 Sep. 2, 2021

Related U.S. Application Data

(60) Provisional application No. 62/982,447, filed on Feb. 27, 2020.

(51) Int. Cl.
*E21B 44/04* (2006.01)
*E21B 49/00* (2006.01)

(52) U.S. Cl.
CPC ..... *E21B 44/04* (2013.01); *E21B 49/003* (2013.01)

(58) Field of Classification Search
CPC ..... E21B 44/04; E21B 47/007; E21B 49/003
See application file for complete search history.

(56) References Cited

U.S. PATENT DOCUMENTS

2016/0117424 A1* 4/2016 Hohl ..... E21B 44/00 703/2
2016/0348493 A1 12/2016 Hohl
2018/0371889 A1* 12/2018 Hohl ..... E21B 47/12
2019/0257153 A1 8/2019 Badkoubeh et al.

FOREIGN PATENT DOCUMENTS

JP 2002155694 A 5/2002
WO 2016081246 A1 5/2016

OTHER PUBLICATIONS

International Search Report Issued in International Application No. PCT/US2021/019950 dated Jun. 8, 2021; 4 Pages.
Written Opinion Issued in International Application No. PCT/US2021/019950 dated Jun. 8, 2021; 3 Pages.

* cited by examiner

*Primary Examiner* — Kristyn A Hall
(74) *Attorney, Agent, or Firm* — Cantor Colburn LLP

(57) ABSTRACT

A method of estimating a stability value of a rotating downhole component includes rotating the downhole component at a varying first rotary speed, the varying first speed having a plurality of first rotary speed values, and identifying an oscillation of the downhole component. The method also includes acquiring measurement data from a sensor, the measurement data indicative of a measured parameter related to the oscillation of the downhole component at the plurality of first rotary speed values, and estimating the stability value of the rotating downhole component as a function of an operational parameter based on the acquired measurement data.

21 Claims, 14 Drawing Sheets

DRILLING EVALUATION BASED ON COUPLED TORSIONAL VIBRATIONS

CROSS-REFERENCE TO RELATED APPLICATIONS

This application claims the benefit of U.S. Provisional Application No. 62/982,447 filed on Feb. 27, 2020, the disclosure of which is incorporated herein by reference in its entirety.

BACKGROUND

Various types of drill strings are deployed in a borehole for exploration and production of hydrocarbons. A drill string generally includes drill pipe or other tubular and a bottomhole assembly (BHA). While deployed in the borehole, the drill string may be subject to a variety of forces or loads. For example, the BHA or other components can experience torsional vibrations having various frequencies. Such vibrations, including high-frequency vibrations, can cause irregular downhole rotation, reduce component life and compromise measurement accuracy.

Severe vibrations in components (e.g., drill strings and bottomhole assemblies) can be caused by cutting forces at the bit or mass imbalances in downhole tools such as mud motors. Negative effects include reduced rate of penetration, reduced quality of measurements and downhole failures.

SUMMARY

An embodiment of a method of estimating a stability value of a rotating downhole component includes rotating the downhole component at a varying first rotary speed, the varying first speed having a plurality of first rotary speed values, and identifying an oscillation of the downhole component. The method also includes acquiring measurement data from a sensor, the measurement data indicative of a measured parameter related to the oscillation of the downhole component at the plurality of first rotary speed values, and estimating the stability value of the rotating downhole component as a function of an operational parameter based on the acquired measurement data.

An embodiment of an apparatus for estimating a stability value of a rotating downhole component includes a sensor configured to generate measurement data indicative of a measured parameter related to an oscillation of the downhole component, the downhole component being rotated at a varying first rotary speed, the varying first rotary speed having a plurality of first rotary speed values. The apparatus also includes a processor configured to acquire the measurement data and perform identifying an oscillation of the downhole component, acquiring measurement data from the sensor, the measurement data indicative of a measured parameter related to the oscillation of the downhole component at the plurality of first rotary speed values, and estimating the stability value of the rotating downhole component as a function of an operational parameter based on the acquired measurement data.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Figure 1:
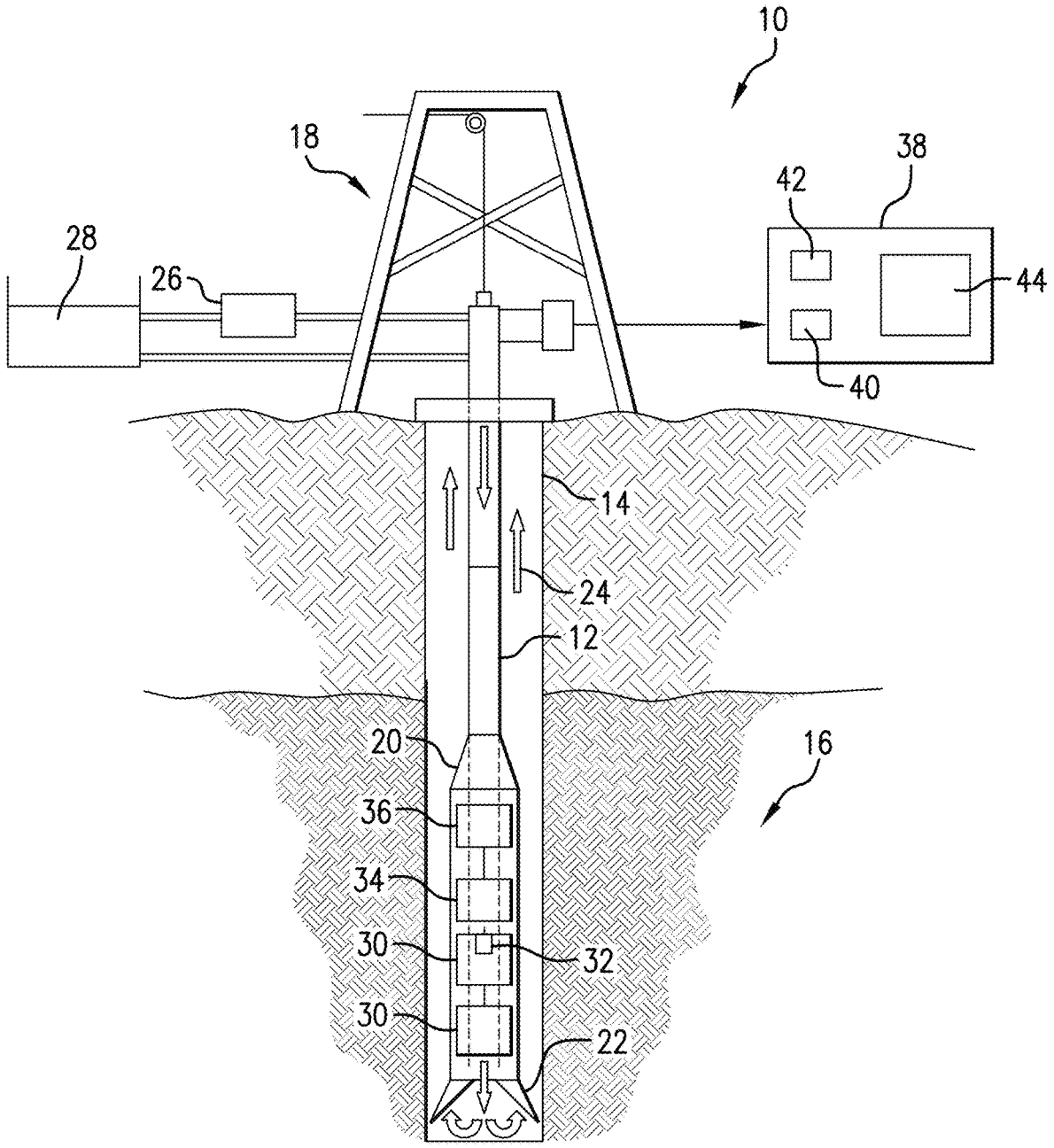
FIG. 1 depicts an embodiment of a drilling and/or formation measurement system including a processing device configured to perform a stability analysis.

Methods, systems and apparatuses for evaluating vibrational behavior of downhole components and/or adjusting operational parameters based on the behavior are described herein. An embodiment of a method of performing a stability analysis includes collecting vibration measurement data (e.g., high speed data with a sampling rate greater than about 1000 Hz or 2500 Hz) related to downhole vibrations of a borehole string, drill bit, tool and/or other downhole component(s). The vibration measurement may be related to a torsional oscillation. The stability analysis is performed based on the vibration measurement data and properties of known oscillation modes that are related to vibration, (which can be determined by, e.g., analytical numerical modeling based on geometry and material properties of the component or components, or by other methods), to determine contributions of different oscillation modes to vibrational behavior of a drill string or other component. As a result, a control system and/or operator can effectively assess the stability of the component under various operating conditions, and control operational parameters to increase stability and avoid unwanted or potentially harmful vibrations, such as high-frequency torsional oscillations and oscillations due to stick-slip. Stick-slip is characterized by absorption and release of energy as a function of the difference between static and dynamic friction, and can lead to irregular rotational movement of a downhole component in a drilling operation, due to being stuck at some point and then being released. Conventionally, high-frequency torsional oscillations and stick-slip phenomena have been treated independently when determining mitigation strategies. In contrast, embodiments described herein treat high-frequency torsional oscillations and stick-slip operations as having a strong coupling between both oscillations. Determining mitigation strategies for coupled high-frequency torsional oscillations and stick-slip are beneficial and can increase operational efficiency.

The stability analysis includes estimating a damping property associated with a first oscillation mode based on sampled vibration measurement data of vibration related parameters and information regarding the first oscillation mode (e.g., modal properties such as the natural frequency, modal damping and/or mode shape). The first oscillation mode may be any mode associated with component vibration and is not limited to any particular mode.

Based on the damping property and vibration measurement data, a resistance characteristic is estimated. A "resistance characteristic" refers to any property or parameter (e.g., coefficient of friction, effective damping, torque at the bit) that is related to damping due to interaction between the component (e.g., drill bit) and material in a subterranean region (e.g. earth formation, borehole casing) as a function of displacement, velocity and/or acceleration of a portion of the component. The resistance characteristic can be determined by using the coupling between different modes (e.g., a high-frequency torsional oscillation mode and a stick-slip mode), and allows for calculation of the amplitudes of vibrations associated with each oscillation mode and the relative contributions of each mode. The resistance characteristic can be, for example, the drilling torque as a function of the displacement, velocity and/or acceleration of a portion of the component. The resistance characteristic can further be influenced by the downhole weight on bit (WOB) between a cutting structure (drill bit or reamer) and the formation or a casing, liner or other deployed component. Further, any substitute method used for stability analysis, such as an energy transfer and balance analysis, may be used. In the case of torsional oscillations, the displacement is an angular displacement, the velocity is an angular velocity and the acceleration is an angular acceleration. As described herein "amplitudes" may include amplitudes of angular displacement, angular velocity, angular acceleration, torque on bit (TOB) and/or amplitude of the corresponding modal coordinates of an oscillation. The angular velocity may also be referred to as rotary speed, rotational velocity, angular velocity, and/or tangential velocity. In an embodiment, the torque on bit (TOB) is the measured torque at different locations along the borehole string and belongs to the parameters associated with a given oscillation mode. The torque at the bit is the torque acting on the bit and is caused by an external force due to the interaction with material in a subterranean formation (e.g. cutting forces, friction forces, etc.).

The resistance characteristic is estimated, for example, by calculating a curve, a data cloud or other reference pattern based on the vibration measurement data and the information regarding a first oscillation mode. A stability value is calculated for each oscillation mode by comparing a property of the reference pattern of the resistance characteristic to the modal properties (e.g., angular eigenfrequency or natural frequency, mode shape, modal damping) associated with a given mode. For example, a stability value may be calculated by comparing a damping property associated with an exciting force (e.g. a torque at the bit associated damping) with the modal damping of the given mode. For example, a first stability value for a first mode (e.g., a high-frequency torsional oscillation mode) is calculated based on the reference pattern and the vibration measurement data, and a second stability value for a second mode (e.g., a mode associated with stick-slip) is calculated based on the reference pattern and information regarding the second mode.

In one embodiment, the resistance characteristic is a resistance characteristic curve, which is a function of angular velocity and can be analyzed with respect to each oscillation mode to derive a stability value.

For example, the resistance characteristic curve is analyzed with respect to each mode to calculate an effective damping value for a given set of operational parameters (e.g., torque at bit, also referred to cutting torque or torsional torque resulting from a weight on bit (WOB), hook load, flow rate, rotation created at surface (surface rotary speed)). The effective damping value for a given mode provides an indication as to whether the downhole component is stable, or whether the component is unstable due to the given mode.

The resistance characteristic curve may be calculated for different sets of operational parameter values. For example, resistance characteristic curves can be derived for each of a variety of different combinations of WOB and TOB or various combinations of WOB, TOB, and angular velocity values. Based on the resistance characteristic curves, stability values associated with each mode can be derived for the different combinations of operational parameters and used to generate a stability map. An operation can be planned and/or controlled based on information from the stability map to ensure that downhole component behavior is stable.

Stability values may be calculated for various parameters, such as operational parameters and/or other parameters. Example of other parameters include component parameters such as BHA and/or other component design parameters (e.g. length, diameter, etc.), and formation parameters such as rock properties. Such parameters can be useful for analysis of BHA and/or other component designs.

The stability values and/or stability maps can be used for various purposes. Operational parameters of a subterranean operation (e.g., a drilling operation) can be planned and/or controlled to reduce or mitigate the onset of potentially harmful or detrimental vibrations, such as high-frequency torsional oscillations (HFTO) and stick-slip oscillations (SS). Examples of such operational parameters include flow rate, hook load and rotary speed (such as surface rotary speed).

Embodiments described herein provide a number of advantages and technical effects. For example, the methods described herein provide an effective way to determine the influence of torsional oscillation modes on an operation by accounting for the effects of different modes, and the influence that the modes have on an operation. In addition, using the stability value described herein, drilling performance can be reliably monitored and drilling operations can be improved or optimized to avoid harmful or detrimental vibration modes.

FIG. 1 shows an embodiment of a system 10 for performing an energy industry operation (e.g., drilling, measurement, stimulation and/or production). The system 10 includes a borehole string 12 that is shown disposed in a well or borehole 14 that penetrates at least one earth formation 16 during a drilling or other downhole operation. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials that may be encountered in a subsurface environment and surround the borehole 14.

The borehole string 12 is operably connected to a surface structure or surface equipment 18 such as a drill rig, which includes or is connected to various components such as a surface drive or rotary table for supporting the borehole string 12, rotating the borehole string 12 and lowering string sections or other downhole components. In one embodiment, the borehole string 12 is a drill string including one or more drill pipe sections that extend downward into the borehole 14, and is connected to a bottomhole assembly (BHA) 20.

The BHA 20 includes a drill bit 22, which in this embodiment is driven from the surface, but may be driven from downhole, e.g., by a downhole mud motor. The surface equipment 18 includes components to facilitate circulating fluid 24 such as drilling mud through the borehole string 12 and an annulus between the borehole string 12 and the borehole wall. For example, a pumping device 26 is located at the surface to circulate the fluid 24 from a mud pit or other fluid source 28 into the borehole 14 as the drill bit 22 is rotated.

The system 10 may include one or more of various tools 30 configured to perform selected functions downhole such as performing downhole measurements, facilitating communications, performing stimulation operations and/or performing production operations. For example, one or more of the downhole tools 30 may include one or more sensors 32 for performing measurements such as logging while drilling (LWD), such as a formation evaluation tool (FE) or measurement while drilling (MWD) measurements. Formation evaluation tool may include a gamma tool, a resistivity tool, a sampling tool, a density tool, a nuclear magnetic resonance tool, or an acoustic tool.

In one embodiment, the sensors 32 are configured to measure parameters related to component rotation and vibrational oscillation. For example, the sensors 32 can include acceleration sensors (e.g., accelerometers, magnetometers, inertia sensors, etc.) and/or torque sensors. The acceleration, magnetometer or torque sensor may be located in, on, or along the downhole system. For example, an acceleration, magnetometer, or torque sensor may be installed at or near the drill bit 22 and/or the BHA, and one or more sensors can be located at desired locations along the borehole string 12.

One or more sensors 32 may be configured to sense amplitudes of vibrations or oscillations over time may be disposed on the drill string or the BHA. For example, one or more sensors 32 may be disposed near the drill bit 22 to sense vibrations or oscillations at a point of excitation of the drill string. The drill bit 22 may be considered a point of excitation due to interaction of the drill bit 22 with a formation rock as the formation rock is being drilled.

The one or more sensors 32 may be located in a drilling dynamics tool, which may be located close to the bit 22, but may be located at any position in or along the borehole string 12. The drilling dynamics tool is designed to sample drilling dynamics data (vibration measurements) at a high timely resolution (e.g., 400 Hz and faster). More than one drilling dynamics tool may be provided, allowing for observation and/or monitoring of drilling dynamics data at different locations. Such drilling dynamics data (vibration measurement data) may include, without limitation, acceleration (lateral, axial, tangential), bending moment (bending torque), torsional torque (e.g. downhole torque at the bit, cutting torque), temperature, pressure, variation in earth magnetic field, weight on bit (e.g. downhole weight on bit or surface weight on bit), and rotary speed (such as downhole rotary speed or surface rotary speed measured in revolutions per minute (RPM).

In one embodiment, the system 10 includes a telemetry assembly 34 such as mud a pulse telemetry (MPT), for communicating with the surface and/or other downhole tools or devices. The telemetry assembly 34 includes, for example a pulser that generates pressure signals through the fluid.

One or more downhole components and/or one or more surface components may be in communication with and/or controlled by a processor such as a downhole processor 36 and/or a surface processing unit 38. In one embodiment, the surface processing unit 38 is configured as a surface control unit which controls various parameters such as rotary speed, weight-on-bit, fluid flow parameters (e.g., pressure and flow rate) and others. In embodiments, communication between downhole components (e.g., downhole tools) and the surface equipment uses wired pipe, electromagnetic telemetry (EM), or acoustic telemetry.

The surface processing unit 38 (and/or the downhole processor 36) may be configured to perform functions such as controlling drilling and steering, controlling the flow rate and pressure of borehole fluid, transmitting and receiving data, processing measurement data, and/or monitoring operations of the system 10. The surface processing unit 38, in one embodiment, includes an input/output (I/O) device 40, a processor 42, and a data storage device 44 (e.g., memory, computer-readable media, etc.) for storing data, models and/or computer programs or software that cause the processor to perform aspects of methods and processes described herein.

Unwanted vibrations can occur during drilling, measurement and other operations due to various factors, such as cutting forces at a drill bit or mass imbalances in downhole tools such as drilling motors. Such vibrations can result in reduced rate of penetration, reduced quality of downhole measurements, and can result in wear, fatigue, and/or failure of downhole components. As appreciated by those of skill in the art, different vibrations exist, such as lateral vibrations, axial vibrations, and torsional vibrations. Examples of torsional vibrations include stick-slip of the drilling system and high-frequency torsional oscillations ("HFTO").

Torsional vibrations may be excited by self-excitation mechanisms that occur due to interaction of the drill bit 22 or any other cutting structure (e.g., a reamer bit) and the formation 16. During rotation, various components of a drill string can cause various torsional oscillation modes to be generated by self-excitation due to, e.g., interaction with rock. A "mode" generally refers to oscillations having an associated frequency or frequency range, and having a mode shape and a modal damping value.

Two modes that are of interest to a control system and/or operator are referred to as high-frequency torsional oscillations (HFTO) and stick-slip oscillations (SS). The main differentiator between stick-slip and HFTO is the frequency and typical mode shapes. For example, HFTO has a frequency that is typically above 50 Hz compared to stick-slip torsional oscillations that typically have frequencies below 1 Hz. Moreover, the excited mode shape of stick-slip is typically a first mode shape of the whole drilling system whereas the mode shape of HFTO can be of higher order and are commonly localized to smaller portions of the drilling system with comparably high amplitudes at the point of excitation that may be the bit or any other cutting structure, (such as a reamer bit), or any contact between the drilling system and the formation (e.g. by a stabilizer). The loads of high-frequency oscillations can have negative impacts on efficiency, reliability, and/or durability of electronic and mechanical parts of the BHA.

Embodiments are discussed herein in conjunction with two modes, including a HFTO mode and an SS mode or two or more HFTO modes. However, embodiments described herein are not limited, and can be used in conjunction with any of various modes due to different conditions. Also in the following description, the operation for which the stability analysis is performed is a drilling operation. However, the analysis can be performed in conjunction with any operation that can experience torsional vibrations.

A processor, such as the surface processing unit 38 and/or the downhole processor 36, is configured to perform all or part of a stability analysis that provides stability information to a control system and/or operator. The stability analysis is based on identifying self-excitation modes of component vibration (e.g., HFTO and SS modes) using a modal analysis or other type of analysis or simulation. For example, modal properties can be determined using, numerical analysis, analytical analysis, modeling or by analyzing vibration measurement data. The analysis of vibration measurement data can be performed via a modal analysis technique, e.g., stochastic substructure identification method(s), method(s) using time domain data and/or method(s) using frequency domain data (using a Fourier Transformation).

The processor collects measurement data related to component vibration at a selected sampling frequency. For example, downhole sensors at or near a drill bit and/or at other locations along a drill string are sampled at a selected sampling frequency (or rate). The sampling frequency, in one embodiment, is equal to or greater than a frequency (e.g., about 400 Hz) associated with a mode having the highest frequency. In one embodiment, the sampling frequency is at least twice that of the oscillation mode having the highest frequency. For example, vibration measurement data can include high speed data with a sampling rate greater than about 1000 Hz or 2500 Hz.

For example, vibration measurement data is collected at a sampling frequency that is at least as high as the HFTO mode frequency (or frequency of whatever mode has the highest mode frequency). The sampling frequency may, for example, be twice as high as the HFTO mode frequency. Examples of such data include acceleration, torque, rotational (angular, tangential) speed/velocity, displacement (e.g. angular displacements), and others. A damping property of the HFTO mode as a function of rotational velocity and weight (e.g., weight on bit (surface or downhole weight on bit)) or torque (e.g., torque at the bit) is determined from the measurement data. Although embodiments are described herein in relation to torsional oscillation modes, the embodiments are not so limited and can be applied to other oscillation modes, such as axial or lateral oscillation modes (in a direction of a longitudinal axis of a component or perpendicular to a longitudinal axis of a component).

The processor also receives or generates a resistance characteristic or parameters that describe or are related to a resistance characteristic curve. The resistance characteristic is based on the interaction between a component (e.g., drill bit) and formation materials, and is influencing both modes (HFTO, SS). For example, the resistance characteristic can be a reference pattern such as a resistance characteristic curve, which is calculated by converting the calculated damping property to a curve that relates a resistance characteristic (e.g., coefficient of friction, torque at the bit, or bit aggressiveness) to an angular velocity.

A stability value or values can then be calculated based on the resistance characteristic for each mode, to quantify the influence of each mode on stability. For example, a stability map can be generated that includes stability values as a function of operational parameters (e.g., WOB and TOB and rotational speed). The stability map includes regions associated with stable operation, and regions associated with unstable operation due to one or a combination of modes. The stability maps can also include a measure of the stability, regions where the stability is high or low, or where the system is unstable (low, medium, high) or a continuous scale for stability, such as by using a stability value that depends on damping, an amplitude of an oscillation or combinations of oscillations, an intensity of an oscillation or combinations of oscillations, or energy balance or any other related measure. In an embodiment, the stability map display areas of stable and unstable operation. For example the stability may indicate at what weight on bit (WOB), depending on the rotary speed of the bit, an operation is stable.

As noted above, embodiments described herein are not limited to any particular stick-slip or HFTO modes. For example, stick-slip modes may be modes in which the stick-slip is not completely developed. Furthermore, other modes (in addition to or in place of partially or fully developed stick-slip modes or a stick-slip event) could be dominant or significantly contribute to system dynamics. In addition, there may be multiple HFTO modes. If multiple HFTO modes are considered, additional information can be determined, such as a frequency dependent change in the resistance characteristic (as it is common in friction). For example, multiple stick-slip modes (e.g., in controlled applications, up to five or ten torsional oscillation modes that exhibit stick and slip phases) may be considered. This is because of the nonlinear behavior given by a stick-phase.

In one embodiment, if a plurality of critical modes are identified (for example, three or more modes), stability values are calculated for each mode. For example, each identified mode would have a different stability map. The stability map of the most critical mode may be selected and related to, for example, stick-slip.

The stability analysis includes identifying critical vibration modes that may occur during an operation. The critical modes may be identified based on vibration measurement data and information about the downhole component, based on simulation data, and/or stability analysis based on a numerical or analytical modal analysis. For example, a model such as a finite element (FE) model of a drill string is constructed based on drill string properties (e.g., material properties, diameter and other geometric properties, types of components, drill bit type and dimensions, etc.). Based on the model, the natural frequency $\omega_{0,i}$ and mode shape $\Phi_i$ of each mode i can be determined. An estimation for the material damping or modal damping for the mode can be considered, e.g., based on experience or modal analysis of vibration measurement data. In another example, the measured amplitude of vibration measurement parameters at different measurement positions along the downhole component can be matched with known mode shapes to identify critical modes. The measurements at downhole components can be performed at different axial position along a longitudinal axis of the borehole string or downhole component. At a given axial position, the measurement can be made at different radial positions at the borehole string or downhole component, wherein radial position refers to a position along an axis perpendicular to the longitudinal axis of the borehole string. Beside different axial and radial positions, the measurement can be made at different circumferential positions at the borehole string or downhole component, where circumferential position refers to a position along the circumference of the borehole string or downhole tool in a direction perpendicular to the longitudinal axial and radial axis of the borehole string.

Critical modes involve those modes that are most likely to be excited at the excitation position (e.g., bit) and tend to be unstable. An "unstable" mode is a mode for which the oscillation amplitude is increasing over time, for example, with a linear, non-linear or exponential function. A "stable" mode is a mode for which the oscillation amplitude is not significantly increasing over time (e.g., the oscillation amplitude does not increase, or increases at a rate below a selected threshold rate).

In one embodiment, critical modes are determined based on a criticality criteria Sc,i, represented by the following:

$$S_{c,i} = -\frac{2D_i\omega_{0,i}}{\varphi_{i,j}^2}, \tag{1}$$

where $D_i$ is the modal damping of an i-th mode, and $\varphi_{i,j}$ is the mass normalized modal amplitude of the i-th mode at a j-th node or measurement location along the downhole component (e.g., the node of excitation, e.g. at a drill bit). In one embodiment, if oscillation modes are generated at a drill bit, the mass normalized modal amplitudes $\varphi_{i,bit}$ of all critical modes at the bit are determined. A similar measure could be included that considers the interaction with other modes of oscillation that can influence the stability value.

In the following, two critical modes are considered, however embodiments described herein can be applied to any number of modes. A first mode is an HFTO mode having a frequency $\omega_{0,HFTO}$ and a mass normalized modal amplitude at the bit $\varphi_{HFTO,Bit}$. A second mode is a stick-slip mode with a frequency $\omega_{0,SS}$ and a mass normalized modal amplitude at the bit $\varphi_{SS,Bit}$.

For each identified critical mode i, the modal damping Di can be estimated. The modal damping can be estimated, for example, by comparing measurement data to calibration data taken when the drill string was operating in a known mode, e.g., by performing an operational modal analysis.

The effective damping can be determined based on fluctuations in the rotary speed of the borehole string or the downhole component. Such fluctuations in rotary speed could be a function of stick-slip oscillations or some other fluctuations around the operational rotary speed (intended rotational speed of the drill bit). The fluctuations in rotary speed can be used to determine the stability value for various rotary speed values. Beside the rotary speed fluctuations due to stick-slip, other controlled or uncontrolled arising rotary speed changes can be used to determine the effective damping. The rotary speed change may be controlled by the rotary table or top drive rotation. In an embodiment, the change in rotary speed of the bit may be controlled by the flow rate of borehole fluid through a mud motor. The fluctuation in rotary speed may be due to a transient rotary speed change (such as a sudden rotary speed increase and/or decay) or by a harmonic rotary speed fluctuation (such as by a pendulum/torsional movement of the downhole component).

For this purpose, in one embodiment, the vibration measurement data is separated into static and dynamic components. A static component in this context refers to slowly changing vibration measurement data with time, and a dynamic component refers to fast changing vibration measurement data. For example, torque on bit (TOB) and/or acceleration measurements can be separated into dynamic components, allowing for the estimation of damping without the need to analyze the static components. Further, the measurement data can be separated by the frequency content, e.g., by separating the low-frequency content (static component) from the high-frequency content (dynamic component) or separating different frequency ranges based on the information regarding expected natural frequencies of expected modes. The static component being associated with a varying rotary speed or alternatively with a varying angular acceleration. The dynamic component being also associated with a varying rotary speed or alternatively with a varying angular acceleration. The variation of the rotary speed (angular acceleration) of the static component (low frequency content) is significantly slower than the variation of the rotary speed (angular acceleration) of the dynamic component (high frequency content).

Low-frequency content may refer to components having a frequency smaller than about 1 Hz, smaller than about 5 Hz, smaller than about 10 Hz, smaller than about 30 Hz or smaller than about 50 Hz. In an alternative embodiment, low-frequency may refer to a frequency that is about 5 times smaller, about 10 times smaller, about 50 times smaller, or about 100 times smaller than the frequency of the high-frequency content. For example, the rotary speed over time relating to the static content (static component) of the vibration measurement data includes an envelope curve (static component envelope). The rotary speed over time of the dynamic component also includes an envelope curve (dynamic component envelope). The bit is not turning backwards. Therefore, the values of the envelope curve of the dynamic component is always smaller than or equal to the envelope values of the envelope curve of the static envelope.

Figure 2:
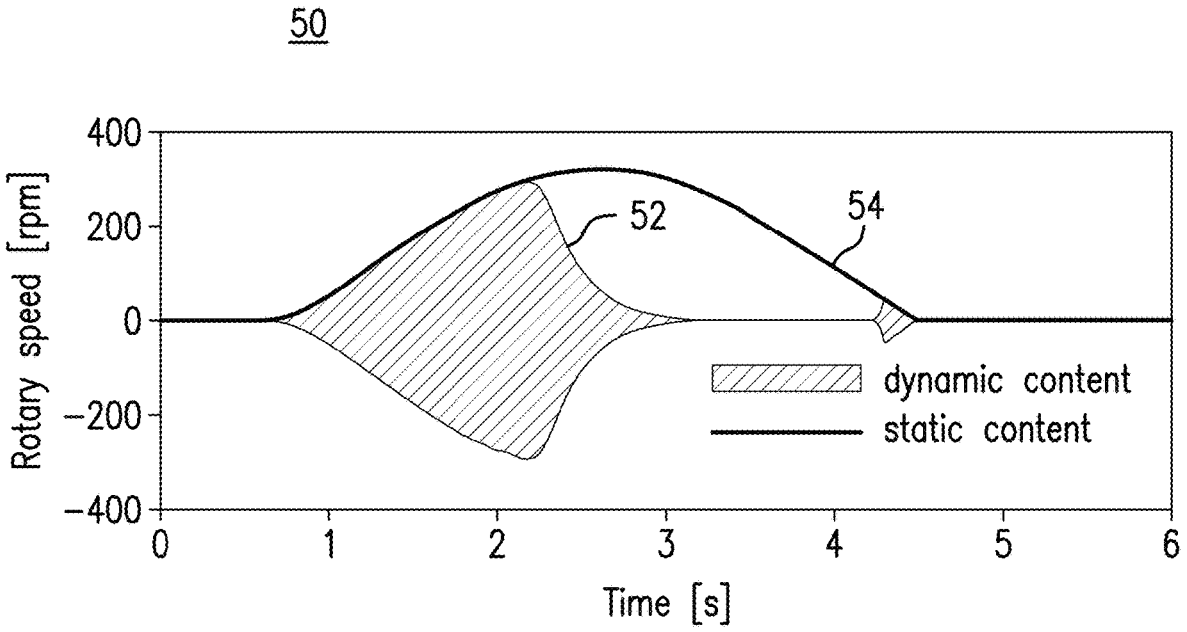
FIG. 2 is a graph depicting an example of dynamic and static components of vibration measurement data.

FIG. 2 is a graph 50 depicting an example in which an envelope curve 52 of the rotary speed associated with the dynamic component of vibration measurement data becoming only as big as an envelope curve 54 of the rotary speed associated with the static component. In this example, the dynamic component is a HFTO mode and the static component is a stick-slip mode. Another relation between the rotary speed of the static and dynamic components is the frequency of the maximum amplitudes of the frequency spectra. The maximum amplitude of the frequency spectrum of the static component appears at a smaller frequency than the maximum amplitude of the frequency spectrum of the dynamic component of the vibration measurement data. In yet another relation between the static component and the dynamic component, the rotary speed of the static component is compared to the rotary speed of the dynamic component. The vibration measurement data used in the described method are recorded during time intervals in which the maximum variation of the rotary speed of the dynamic component (slope of the rotary speed of the dynamic component over time) is higher than the maximum variation of the rotary speed of the static component (slope of the rotary speed of the static component over time). It is to be appreciated that the vibration measurement data may comprise noise, which may lead to contributions to the envelope curves, the frequency spectra or the rotary speed values that may deviate from the pure law of physics as described here.

Figure 3A:
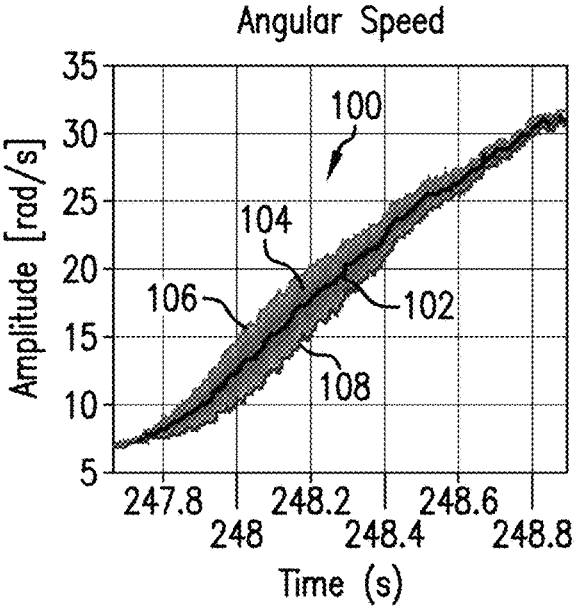
FIGS. 3A, 3B, 3C, and 3D depict examples of vibration measurement data and the effect of various oscillation modes thereon.
Figure 3C:
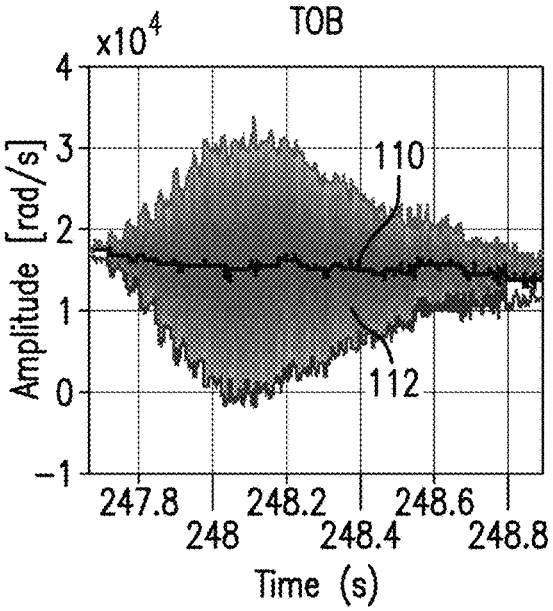
Figure 3B:
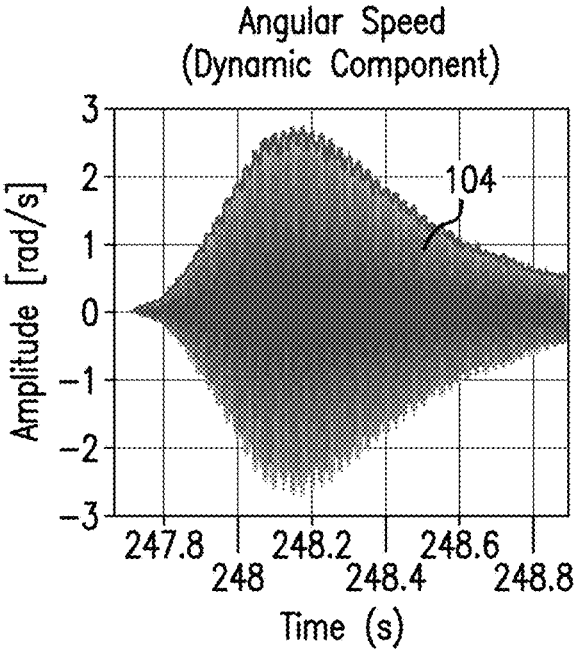
Figure 3D:
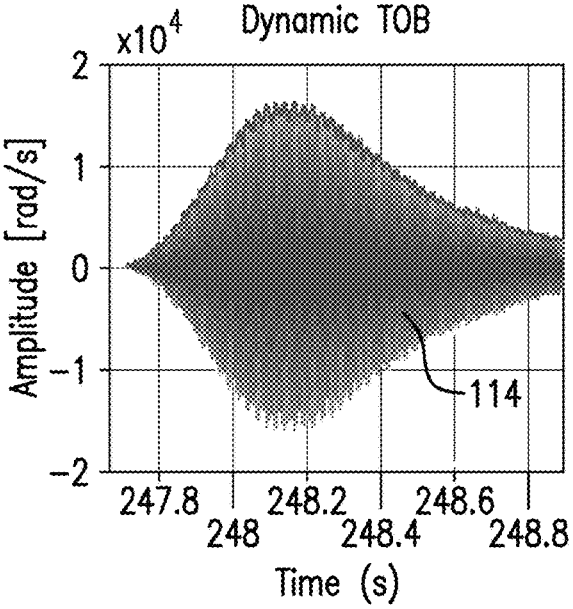

FIGS. 3A, 3B, 3C, and 3D (collectively referred to as FIG. 3) depict an example of torque and angular velocity measurement data for a drill bit or other component that is affected by multiple oscillation modes. In this example, the oscillation modes include an HFTO mode and a stick-slip mode. FIG. 3A shows rotary or angular speed measurements 100 over time, which can be represented as one or more curves. The angular speed measurements 100 include superposition of the low-frequency content (e.g., related to stick-slip). The low-frequency content is represented by curve 102 (static component), and the high-frequency content is represented by curve 104 (dynamic component). The high-frequency component in this example is the HFTO component of the measurement data. The HFTO component 104 is framed by upper and lower bounds 106 and 108, which represent the limit in amplitude for the harmonic signal of the HFTO mode. FIG. 3B shows the dynamic content of the angular velocity measurement data 104 of FIG. 3A associated with a mode of HFTO. FIG. 3C shows static and dynamic components of torque on bit (TOB) measurements over time. The static component is represented as a curve 110, and the dynamic component is represented by curve 112, also along with harmonic TOB measurements of the HFTO mode. FIG. 3D shows dynamic content 114 of the TOB measurement data (HFTO component). The dynamic content can be observed in vibration measurement parameters such as the dynamic torsional torque measurement, angular or tangential acceleration measurement or in the angular velocity fluctuation.

As shown, the HFTO-related amplitudes (signals 104 and 112) increase and decrease during a cycle of the lower frequency content of the stick-slip mode. Therefore, the identified effective damping is dependent on the low-frequency content of the rotary speed (and (static) WOB or TOB). A cycle of lower frequency content refers to the velocity variation during one stick-slip cycle, from stick to slip phase and back to stick phase. The concept using the coupling of stick-slip modes and high-frequency modes is explored in A. Hohl et al., "The nature of the interaction between stick-slip and high-frequency torsional oscillations", IADC/SPE-199642-MS, 2020, which is hereby incorporated by reference in its entirety.

In one embodiment, the damping associated with the self-excited HFTO mode (or other relatively high-frequency mode) is the angular velocity dependent equivalent damping Deq, which is determined based on the high-frequency (e.g., at least the HFTO frequency) downhole vibration measurement data. For this purpose, vibration measurement data is divided into a dynamic and a static component, as discussed above. The dynamic component or high-frequency content is used to determine the stability or effective damping for the mode and the static component or low-frequency content of the rotary speed, and WOB or TOB are used to put the vibration measurement into the context of the operational parameters of the stability map.

Various methods to determine the damping or associated values such as the energy from the dynamic component of the vibration measurement data are available in time and frequency domain. In the time domain, various methods may be used, such as the complex exponential method, the Ibrahim method, the logarithmic decrement method, and a method based on energy balance. In the frequency domain, the damping can be determined using methods such as determining damping by the half-width, various least square frequency domain methods, modal phase separation methods and/or identification of structural system parameters (ISSPA).

The following is a description of examples of determining the effective damping associated with the HFTO mode. In a first example, a logarithmic decrement method is used, which assumes a single dominant oscillating frequency. To increase accuracy, the measurement data can be filtered with a band pass filter with respect to the characteristic natural frequency $\omega_{0,HFTO}$ of the HFTO mode. Subsequently, the damping as a function of angular velocity can be determined by the logarithmic decrement A from two neighboring oscillation amplitudes $\hat{x}_n$, $\hat{x}_{n+1}$, represented by:

$$\Lambda = \ln\frac{\hat{x}_n}{\hat{x}_{n+1}}. \tag{2}$$

The damping for different amplitudes $D_{eq}(v_{RPM})$ can thus be determined over the entire oscillation process for various rotational velocities $v_{RPM}$ based on the following equation:

$$D_{eq} = \frac{\Lambda}{\sqrt{4\pi^2 + \Lambda^2}} \tag{3}$$

The angular velocity (rotary speed) associated with the equivalent damping Deq can be determined from the low-frequency stick-slip oscillation.

Alternatively, the torque $M_{Bit}$ acting on the bit (torque at the bit) and responsible for the self-excitation can be used to determine the equivalent damping $D_{eq}$ by determining the supplied energy from the torque at the bit $M_{Bit}$ over one HFTO period $T_{HFTO}$ as follows:

$$E_{eq} = \int_{t_0}^{t_0+T_{HFTO}} M_{Bit} \cdot \dot{x}^2_{HFTO,Bit} dt. \tag{4}$$

The torque at the bit represents the dynamic torque at the bit and/or the friction experienced while drilling the formation. The torque at the bit comprises cutting torque and other torque components originating from friction, rolling, sliding, grinding, viscous forces due to the drilling mud, and others. Different torque component may act on different parts of the bit or the borehole string, such as cutters, blades, outer surfaces or fluid channels.

To calculate the equivalent damping, the physical angular velocity $\dot{x}_{HFTO,Bit}$ is transferred into the dynamic amplitude of the HFTO mode at the bit:

$$\dot{q}_{HFTO,\,Bit} = \frac{\dot{x}_{HFTO,Bit}}{\varphi_{HFTO,Bit}} \tag{5}$$

The equivalent damping can then be calculated based on the following equation:

$$D_{eq} = \frac{E_{eq}}{2\omega_{0,HFTO}\int_{t_0}^{t_0+T_{HFTO}} \dot{q}^2_{HFTO,\,Bit} dt}. \tag{6}$$

This alternative approach to determining the equivalent damping $D_{eq}$ by the energy input allows for determination of a velocity dependent damping for non-exponentially increasing or decreasing vibrations. By comparing the energy input and output, a stability criterion has been developed that is valid for one operational point (a value of rotary speed at the bit, and certain constant weight on bit (WOB)). The stability criterion represents the limit slope of the torque at the bit with respect to the rotary speed for each torsional mode for a marginally stable system.

The previously determined velocity-dependent equivalent damping $D_{eq}$ is composed of the modal damping $D_{HFTO}$ and a torque at the bit associated damping $D_c$ defined by a resistance characteristic:

$$D_c = D_{eq} + D_{HFTO}. \tag{7}$$

The equivalent damping $D_{eq}$ is a measure for effective self-excited damping.

The resistance characteristic can be represented by a variety of properties and parameters. The resistance characteristic includes some parameter or property related to interaction between the drill bit and formation materials (e.g., rock). Examples of a resistance characteristic include frictional parameters and bit aggressiveness.

The damping of any damping device or tool (passive or active) can be considered to determine a damping or energy dissipation value to judge the stability of the system. Damping can be based on friction, viscous damping, magnetic damping, etc. The damping can be added in simulations to compare or estimate the damping with or without the device and the following stable operational range. The amount of damping or number of dampers or placement of dampers can be adjusted to achieve a stable damping in a preferred operational parameter range. The preferred operational parameter range can be a range within which a bit or cutting device is having a high performance. A high performance can mean, for example that a drill bit or other component does not experience excessive wear, a sufficiently high rate of penetration is achieved, and/or no vibrational dysfunctions are exhibited.

In one embodiment, the resistance characteristic is provided as a resistance characteristic curve. The resistance characteristic curve can be analyzed with respect to each mode to derive a stability value, such as an amplitude of an oscillation mode or an intensity of an oscillation mode. The stability values of modes can be overlaid or shown separately.

In one embodiment, a resistance characteristic curve is estimated as a function of angular velocity for a given rotary speed (operational rotary speed, e.g., surface rotary speed). The curve is calculated with respect to each mode, by determining the slope $$\frac{dr}{d\dot{x}}$$

of the resistance characteristic curve at a specific rotary speed and WOB. The variable r refers to a coefficient of friction. In an alternative embodiment, the variable r may be a torque at the bit.

The resistance characteristic curve can be calculated as follows:

$$\frac{dr}{d\dot{x}} = \frac{2\omega_{0,HFTO} D_c}{\varphi^2_{HFTO,Bit}}. \tag{8}$$

The dynamic torque acting on the bit (torque at the bit) can be determined by integrating the gradient $$\frac{dr}{d\dot{x}}$$

and using a support point (extracted from the measurements), such as the mean TOB at the mean rotary speed (RPM). For these torque curves, different WOB values may exist at different RPM values. The torque curves can be considered a resistance characteristic curve. In one embodiment, the torque curve is converted into a property such as bit aggressiveness. The bit aggressiveness can be determined by:

$$\mu = \frac{3TOB}{2R_{Bit}WOB}, \tag{9}$$

where $R_{Bit}$ is the bit radius and TOB and WOB are the dynamic TOB and WOB.

The resistance characteristic may be a single characteristic (e.g., coefficient of friction), or a combination of characteristics related to interaction between a drill bit (or other downhole component) and subterranean material (e.g., earth formation or rock). The determined resistance characteristic (e.g., point cloud from several measurements of various resistance characteristics) may be converted into a resistance characteristic curve.

For example, the data can be fitted into any Stribeck-shaped resistance characteristic curve, such as $$\mu(\dot{x}) = \left(\mu_c + (\mu_H - \mu_C)e^{-\left|\frac{\dot{x}}{v_S}\right|} + b_S|\dot{x}|\right)\operatorname{sign}(\dot{x})$$

with 4 unknown parameters $\mu_c$, $\mu_H$, $v_s$, $b_s$.

Figure 4:
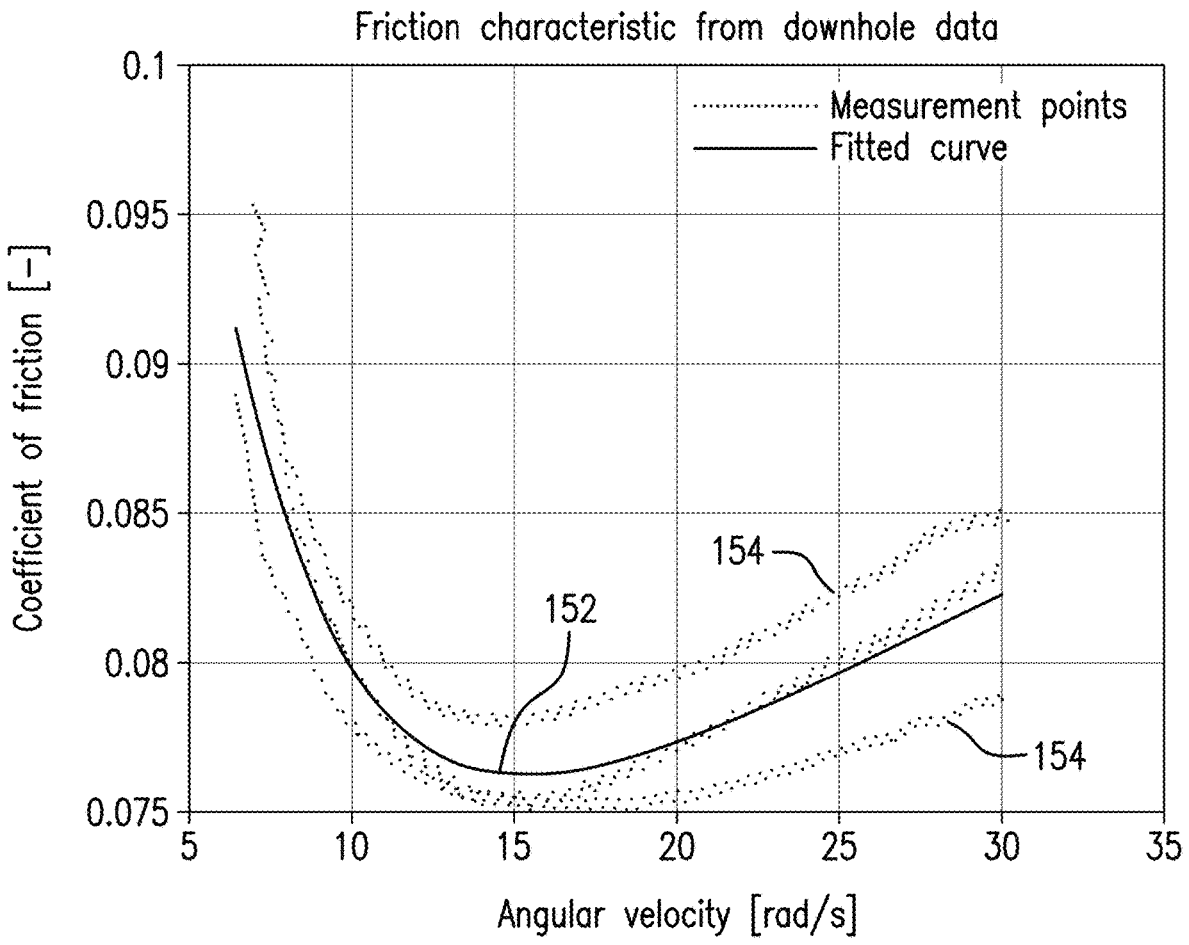
FIG. 4 depicts an example of a resistance characteristic curve used in an embodiment of a stability analysis.

FIG. 4 depicts an example of a resistance characteristic curve 152. In this example, measurement points 154 are taken over different HTFO cycles. The measurement points produce a number of measurement data curves, and fit to a previously defined and parametrized resistance characteristic curve 152 to produce the average resistance characteristic curve from multiple HFTO cycles. The resistance characteristic curve is formation and application (bit, BHA) dependent and can also be influenced by other properties such as the mud properties.

If WOB is changing during the excitation of the mode, this change is considered because the resistance characteristic curve (in one embodiment) is a function of the rotational speed and the WOB. Furthermore, the WOB and TOB at a drill bit can be different from that measured at other locations (e.g., a few meters above the bit). Thus, in one embodiment, numerical modeling (e.g., using Kalman filter techniques) may be used to determine the TOB or WOB at the bit, especially the dynamic components. The resistance characteristic curve may be nonlinear as depicted in FIG. 4. The resistance characteristic depends nonlinearly on the rotary speed (angular speed). In an alternative embodiment, the resistance characteristic depends nonlinearly on angular acceleration, angular displacement, or torque on bit (TOB). The resistance characteristic curve in FIG. 4 follows at least in parts a velocity-weakening torque characteristic as described in A. Hohl et al., "Derivation and validation of an analytical criterion for identification of self-excited modes in linear elastic structures", Journal of Sound and Vibration, pp. 1-12, which is hereby incorporated by reference in its entirety. For angular velocity values between around 7.5 rad/s to around 12.5 rad/s the resistance characteristic comprises a negative slope (the coefficient of friction decreases with increasing angular velocity). This behavior is referred to as a velocity-weakening torque characteristic. Alternatively to plotting the coefficient of friction over the angular velocity, as shown in FIG. 4, the torque at the bit may be plotted over the angular velocity. A velocity-weakening resistance characteristic is a source of energy input in the system. The velocity-weakening resistance characteristic may be found for the low-frequency stick-slip oscillation as well as the high-frequency HFTO oscillation.

The processing device then determines or calculates a stability value using the resistance characteristic. The stability value may be calculated for each selected critical mode. For example, a stability value is calculated using a resistance characteristic curve In one embodiment, a plurality of stability values are calculated for each of a plurality of sets of operational parameters, such as WOB and TOB and rotary speed. For a given set of parameter values, a stability value can be calculated that indicates whether an operation is stable. The stability value may be an amplitude or other value associated with a given mode (such as a continuous damping property, such as the effective damping). The stability values may be combined into a stability map.

Stability values can be calculated using various analyses and/or simulations. For example, an analytical stability map of the individual modes can be found by linearizing the resistance moment with respect to the various modes using the Sc criterion. The effective damping can be calculated from the first derivate $$\frac{dr_j^*}{d\dot{x}_j^*}$$

from the resistance characteristic, e.g. $\mu(\dot{x})$, as follows:

$$D_i^* = D_i + \frac{1}{2\omega_{0,i}} \sum_{j=1}^{N} \varphi_{ij}^2 \frac{dr_j^*}{d\dot{x}_j^*}. \tag{10}$$

If the effective damping $D_i^*<0$ the system is unstable and amplitudes tend to increase. The effective damping can also be used to display a continuous value that represents the amount of the instability or stability. The effective damping $D_i^*$ for mode i in this embodiment corresponds to the equivalent damping $D_{eq_i}$ for the oscillation mode i, and the slope $$\frac{dr_j^*}{d\dot{x}_j^*}$$

corresponds to the slope $$\frac{dr_j}{d\dot{x}_j}.$$

Figure 5A:
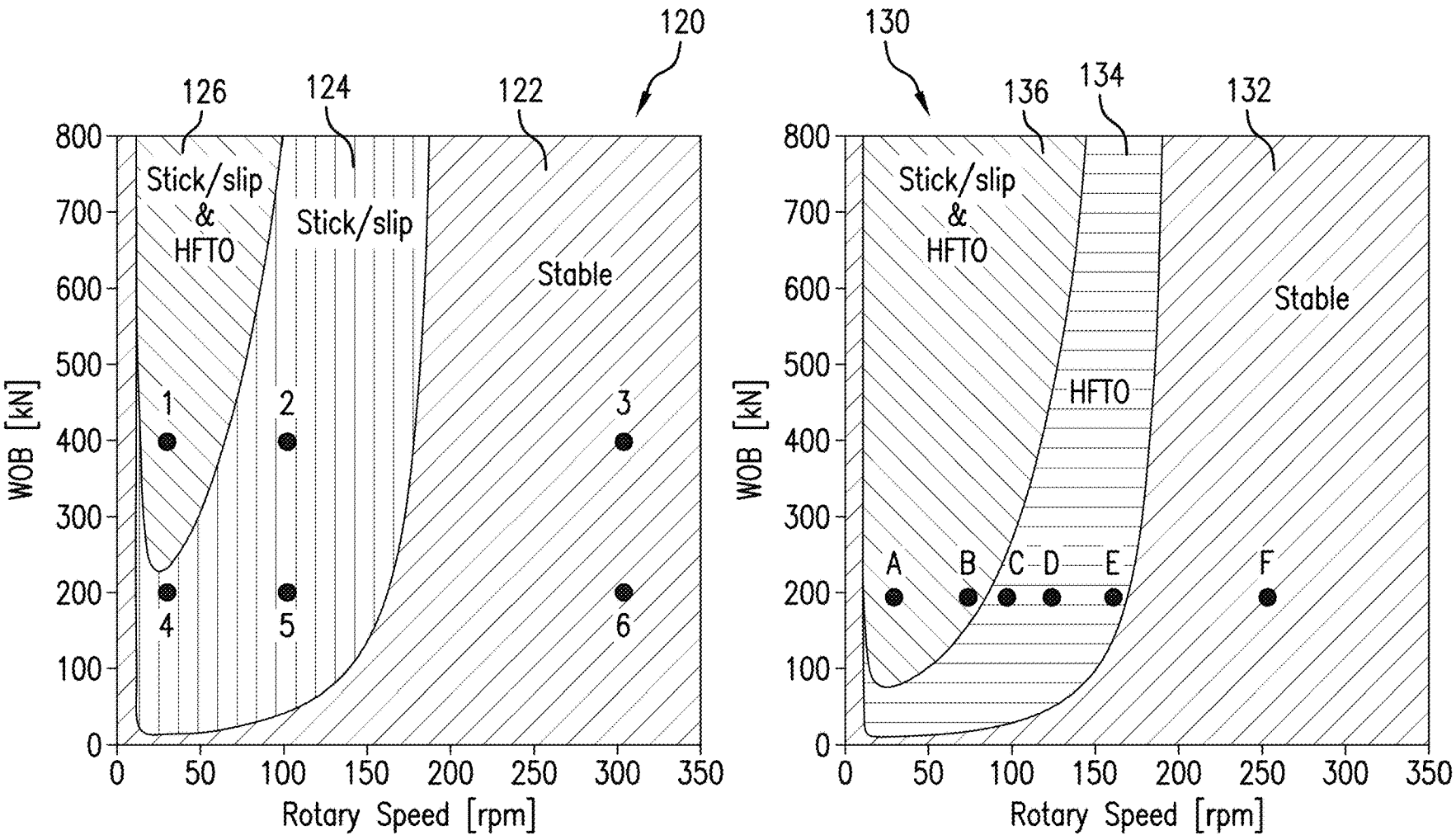
FIGS. 5A and 5B depict examples of stability maps generated based on an embodiment of a stability analysis.
Figure 5B:
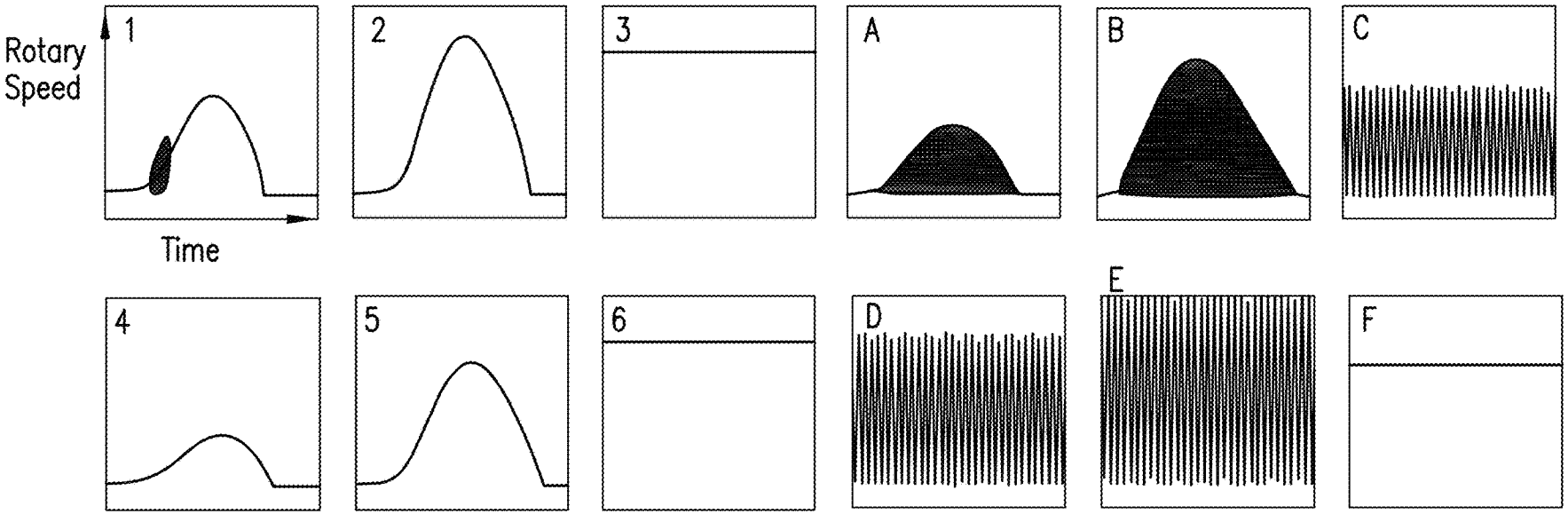

The method may be used to determine an estimation of the expected amplitudes for various modes, such as pure stick-slip, pure HFTO or combinations of both. The expected amplitudes can be derived by analytical equations considering stability borders or limits, an energy integral or numerical or analytical results. This can be based on finite element modeling, analytical models, or lumped mass models or with the transfer matrix method. The expected amplitude can be compared to a critical amplitude. The critical amplitude can be derived by tool limit or based on statistical comparison of failures and loads. Based on the expected amplitudes, decisions can be made with respect to operational parameters, in addition to the estimated stability values FIGS. 5A-5B (collectively referred to as FIG. 5) illustrate examples of stability maps generated, for example, by calculating the effective damping due to each mode, i.e., the HFTO mode and the SS mode. In these examples, a first stability map 120 represents dominant stick-slip. The first stability map includes a stable region 122, an unstable region 124 due to stick-slip and an unstable region 126 due to a combination of stick-slip and HFTO. The unstable region 124 represents operational parameters for which the effective damping from the SS mode is below some selected threshold. The unstable region 126 represents operational parameters for which the effective damping from the SS mode and the effective damping from the HFTO mode are below some selected thresholds. FIG. 5B also shows time domain simulations (denoted 1-6) of various vibration behaviors (slick-slip, HFTO, and stick-slick and HFTO) and their positions on the stability map 120 (shown as points 1-6). The simulations are represented as graphs, each of which represents rotary speed as a function of time.

In these examples, a second stability map 130 represents dominant HFTO. The first stability map includes a stable region 132, an unstable region 134 due to HFTO and an unstable region 136 due to a combination of stick-slip and HFTO. Time domain simulations of various vibration behaviors (denoted A-F) and their positions on the stability map 130 (shown as points A-F).

From the relationship of the stability maps of the HFTO modes and the stick-slip modes, different mitigation strategies can be proposed. For example, WOB and TOB values are selected or adjusted so that they are within the stable region 122 and/or the stable region 132.

Alternatively, different complex simulations can be carried out. The simulations can range from a simulation of a single degree of freedom oscillator, where only one mode (e.g., the HFTO mode) is simulated, to finite element simulations where all modes are considered.

An example of such a simulation uses an oscillator having two degrees of freedom. In this example, two modes that occur simultaneously are simulated, which include a HFTO mode and a SS mode, although any combination of critical modes can be used. The system behavior can be simulated with:

$$\begin{pmatrix} 1 & 0 \\ 0 & 1 \end{pmatrix} \begin{pmatrix} \ddot{q}_{SS} \\ \ddot{q}_{HFTO} \end{pmatrix} + \begin{pmatrix} 2D_{SS}\omega_{0,SS} & 0 \\ 0 & 2D_{HFTO}\omega_{0,HFTO} \end{pmatrix} \begin{pmatrix} \dot{q}_{SS} \\ \dot{q}_{HFTO} \end{pmatrix} + \begin{pmatrix} \omega_{0,SS}^2 & 0 \\ 0 & \omega_{0,HFTO}^2 \end{pmatrix} \begin{pmatrix} q_1 \\ q_2 \end{pmatrix} = \begin{pmatrix} \varphi_{SS,Bit} \\ \varphi_{HFTO,Bit} \end{pmatrix} M(\varphi_{SS,Bit}\dot{q}_{SS} + \varphi_{HFTO,Bit}\dot{q}_{HFTO}), \tag{11}$$

where $q_{ss}$ is the modal amplitude of SS mode oscillations and $q_{HFTO}$ is the modal amplitudes of HFTO oscillations.

Figure 6C:
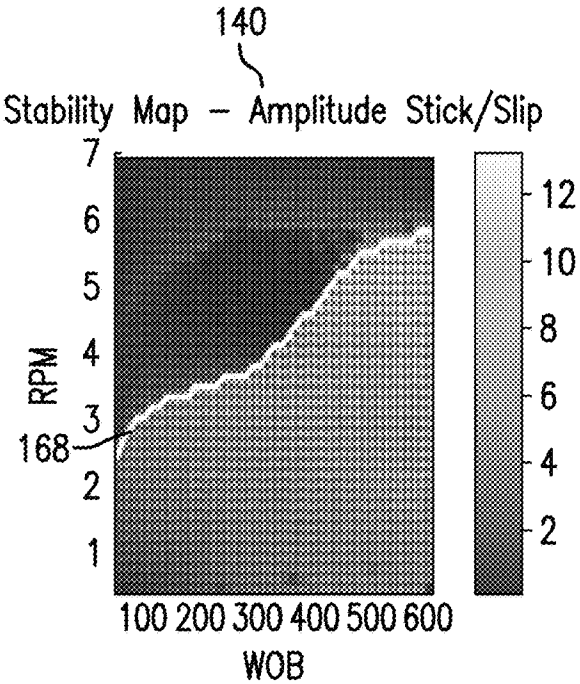
FIGS. 6A, 6B, and 6C depict examples of stability maps generated based on an embodiment of a stability analysis, the stability maps illustrating the effect of oscillation modes on component stability.
Figure 6B:
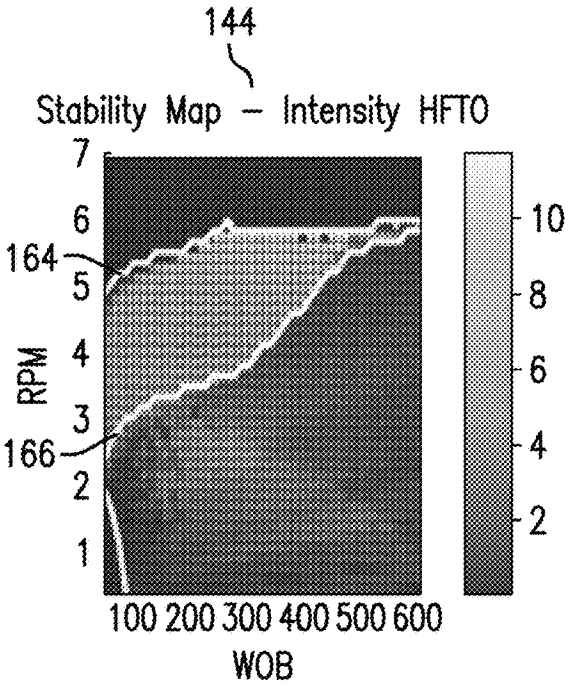
Figure 6A:
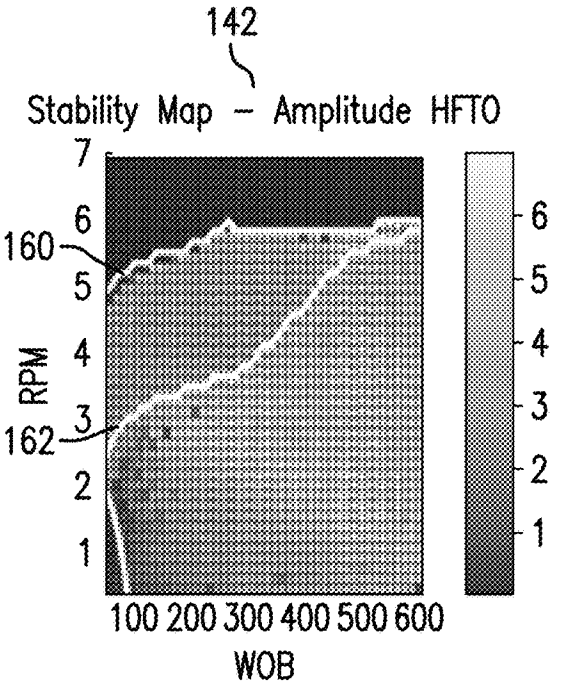

FIGS. 6A, 6B, and 6C (collectively referred to as FIG. 6) depict an example of stability maps generated using the above-mentioned two degrees of freedom simulation. The stability maps are plotted to provide characteristics of the SS mode, the HFTO mode, and may also be plotted based on an interaction between the modes.

For example, FIG. 6C is a stability map 140 that shows the modal amplitude of the low frequency oscillation $\hat{q}_{SS}$ (stick-slip), for various combinations of rotary speed (RPM) and WOB. A stability map 142, as depicted in FIG. 6A, shows the modal amplitude of the high-frequency oscillation $\hat{q}_{HFTO}$ (HFTO), and a stability map 144, as depicted in FIG. 6B, shows the intensity of the high-frequency oscillation (HFTO) interacting with the low-frequency oscillation (SS) calculated as $\int|q_{HFTO}(t)|dt$. The modal amplitude of the stick-slip oscillation indicates to what extent stick-slip occurs, the modal amplitude of HFTO indicates to what extent HFTO occurs, and the intensity of HFTO in interaction with stick-slip indicates how the stick-slip oscillation influences the high-frequency torsional oscillations (HFTO). The bright lines in FIGS. 6A-6C indicate the transitions between stable and instable regions for the HFTO mode (FIG. 6A) and the stick-slip mode (FIG. 6C). These lines are also included in the stability map depicting the intensity of HFTO in interaction with stick-slip (FIG. 6B). It can be seen that the intensity of HFTO in the region with slick-slip is significantly reduced. The bright lines of FIG. 5A are denoted as lines 160 and 162, the bright lines of FIG. 5B are denoted as lines 164 and 166, and the bright line of FIG. 5C is denoted as line 168.

Stability maps and/or other stability information can be produced in real time (e.g., during an operation and/or as data is collected) or produced for subsequent assessment of a drilling operation. For example, the parametrized curve of the resistance characteristic could be determined downhole (e.g. using a downhole measurement and downhole processing tool) in real-time, sent to the surface and be implemented in an automation platform along with optimized mitigation strategies. This would allow for optimal decision making with respect a mitigation of HFTO and stick-slip. In an alternative embodiment, the resistance characteristic may be determined at a surface location using vibration measurement data collected downhole and sent to surface. In another embodiment the stability value or the stability map may be used to generate an alarm when an instable condition occurs.

Further the same process could be done from post well analysis of high-speed vibration measurement data and a formation specific calculation of the stability maps, using formation parameters such as rock material hardness, for the same purpose.

The stability maps can be enriched with the data from any damper. If the damper is added, the resulting stability maps can be presented by combining or adding the (eventually parameter and mode dependent) damping from a damper to derive the stability map with a damper. This could be used to derive new valid stable operational parameters.

The identified resistance characteristics are valuable for bit development and to choose a more or less aggressive bit dependent on the stability maps. Furthermore, the aggressiveness of the bit over time can be determined in any run that could potentially be used for the bit wear analysis. The resistance characteristic changes with declining bit aggressiveness. Therefore, observing a change in the resistance characteristic with increasing bit operation time may indicate wear of the cutting elements of the bit or in general wear of the bit. The resistance characteristic could be identified and related to bit properties or bit wear in real-time or post-well analysis. The stability value or the stability map may be used to select a best suited bit for a specific application (well trajectory (inclination, depth), borehole diameter, and formation). Another application for the use of stability values or a stability map may be the design of new bits addressing drilling loads identified by the stability value or stability map.

Generally, only angular velocity and WOB are used in the determination and characterization of a stability map. This is due to the fact that the angular velocity and WOB are adjustable parameters in the drill string dynamics and can therefore be changed directly to influence the dynamics of the drill string. If further parameters of the system under investigation and/or the vibration (oscillation) are taken into account, both the accuracy of the stability map and the information content for the operator can be increased.

In the following, the estimation of the stability map/resistance characteristic curve taking into account several parameters (e.g. the amplitude of the critical vibration) is explained in order to increase the accuracy of the resistance characteristic curve and stability map and then possibilities are shown to obtain more information for the drilling process from the usual stability map where mainly angular velocity and WOB are considered by taking into account further parameters.

Figure 7A:
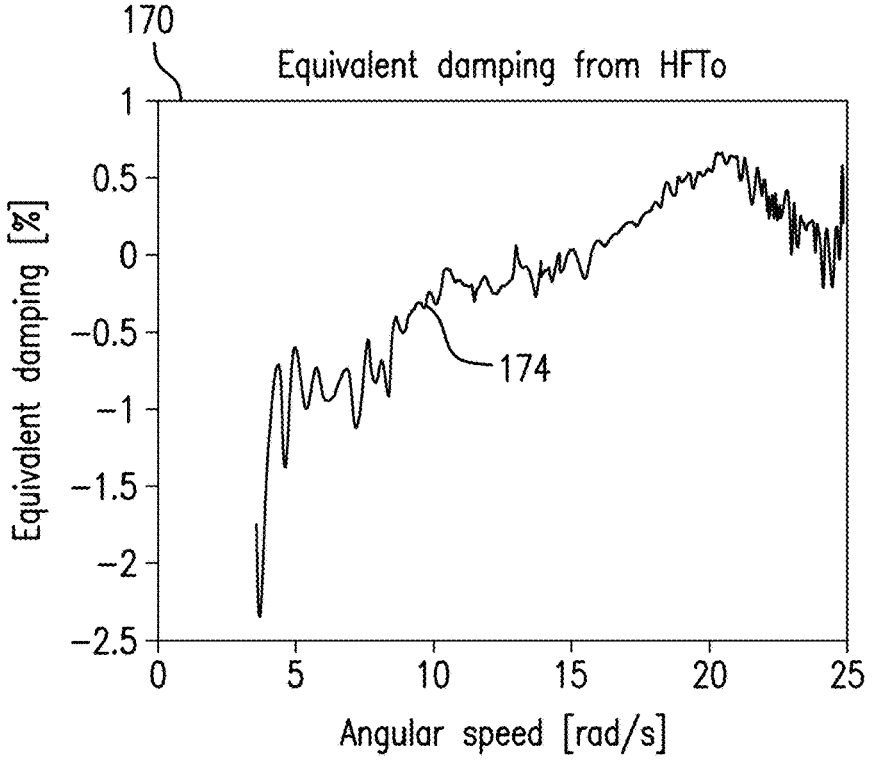
FIGS. 7A and 7B depict graphs of examples of angular speed related to oscillation measurements.
Figure 7B:
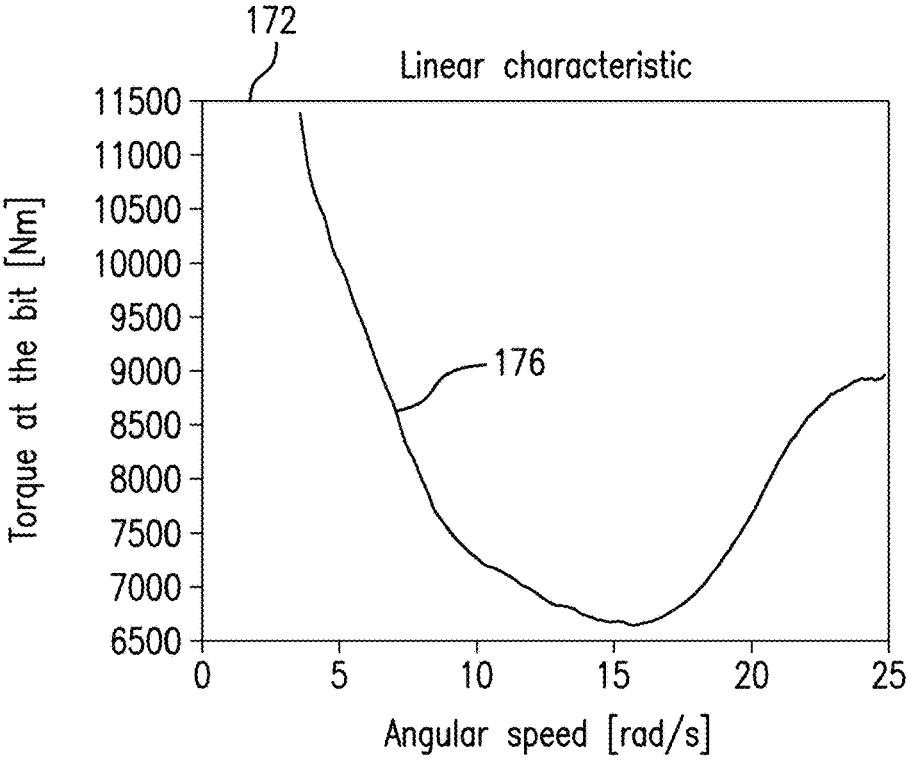

When a stability map or a resistance characteristic curve is determined, the change in energy may be determined directly or indirectly by measuring the drill string vibration (oscillation). This change can be an energy change, an amplitude change, a damping value or any other value describing the change of the oscillation. FIGS. 7A and 7B (collectively referred to as FIG. 7) are graphs 170 and 172 of angular speed related to oscillation measurements. FIG. 7A shows an example of the change in energy (damping) versus angular velocity for a constant force at a drill bit defined by a constant weight on bit (WOB), shown as curve 174. FIG. 7B shows the corresponding resistance characteristic curve 176, which was determined directly from FIG. 7A, taking into account only the angular velocity of the bit and the weight on bit (WOB).

In both FIG. 7A and FIG. 7B, a sudden change in slope can be observed at an angular velocity of about $$9\frac{\text{rad}}{s},$$

which leads to a lower slope of the resistance characteristic curve 176 in FIG. 7B $$\left(\text{between } 9\frac{\text{rad}}{s} \text{ and } 16\frac{\text{rad}}{s}\right).$$

This sudden change of the equivalent/effective damping value in FIG. 7A and the resulting different slope in FIG. 7B can be explained by the kinematics of the drill string in this example.

Figure 8:
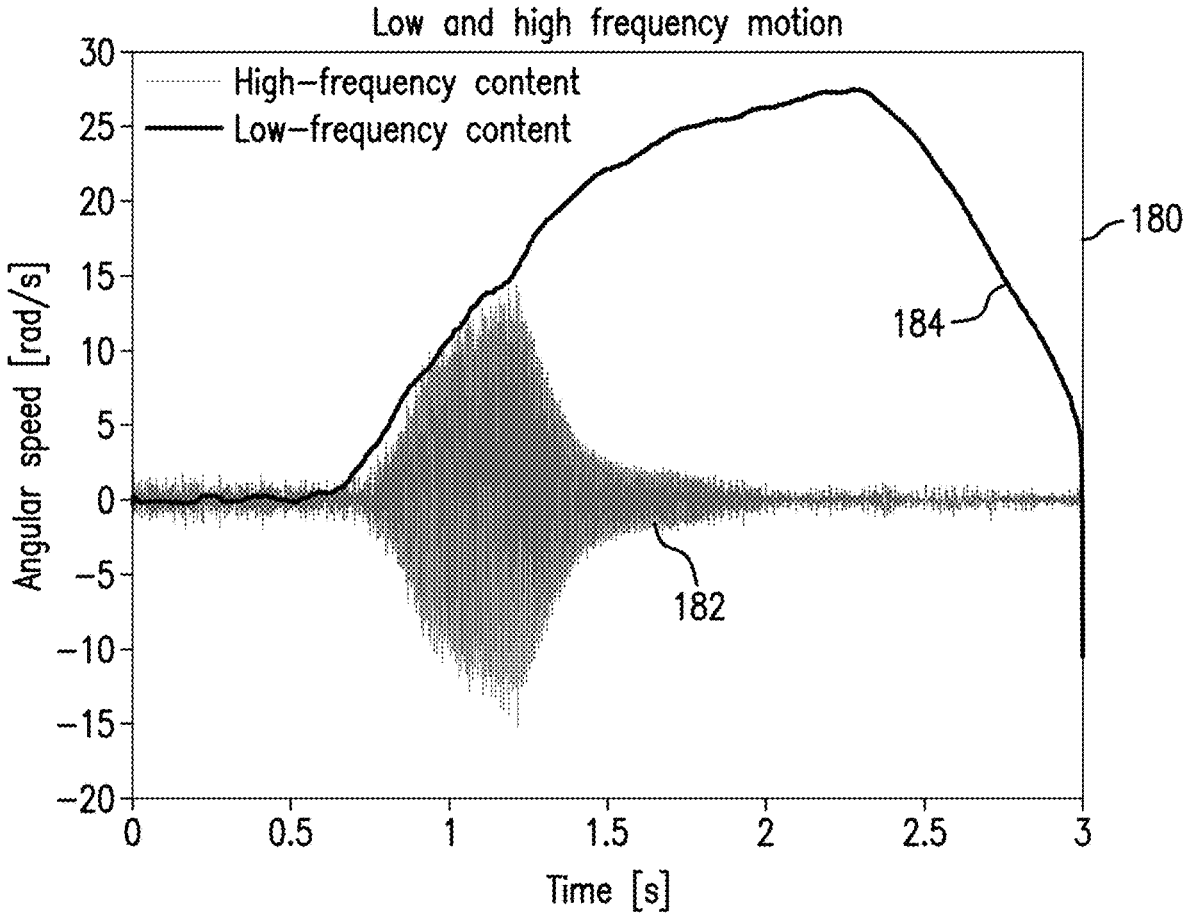
FIG. 8 depicts a graph of an example of low and high-frequency content of an oscillation.

FIG. 8 is a graph 180 that shows the low and high-frequency content of an oscillation (in this case a superposition of stick/slip and HFTO). The high-frequency content is represented by a curve 182, and the low-frequency content is represented by a curve 184. From 0.95-1.2 s, it can be observed that the exponential increase in amplitude of the high-frequency oscillation is limited by the angular velocity of the drill string due to the stick/slip oscillation (low frequency content of the angular velocity). This limitation, i.e., the low-frequency oscillation that acts as slowing down the high-frequency oscillation, explains the sudden slope change in FIGS. 7A and 7B. Such an influence on the high-frequency oscillation by other parameters (in this case the angular velocity of the low-frequency oscillation) leads to large inaccuracies in the resulting resistance characteristic curve and stability map. This effect has a significant impact on the accuracy of the determined stability values. In a case that the low-frequency content of the oscillation influences the behavior of the high-frequency oscillation, another parameter that takes into account the interaction of the low-frequency and high-frequency content can be used in addition to the angular velocity and WOB to determine the resistance characteristic curve and stability map. The inaccuracy due to the angular velocity of the bit (low-frequency content) can be directly attributed to the nonlinearity of the resistance characteristic curve and the relationship between the low-frequency content of the angular velocity and the high-frequency content of the angular velocity (HFTO). The inaccuracy can therefore be attributed to a hysteresis of the high-frequency oscillation. The hysteresis curve may be nonlinear.

Figure 9A:
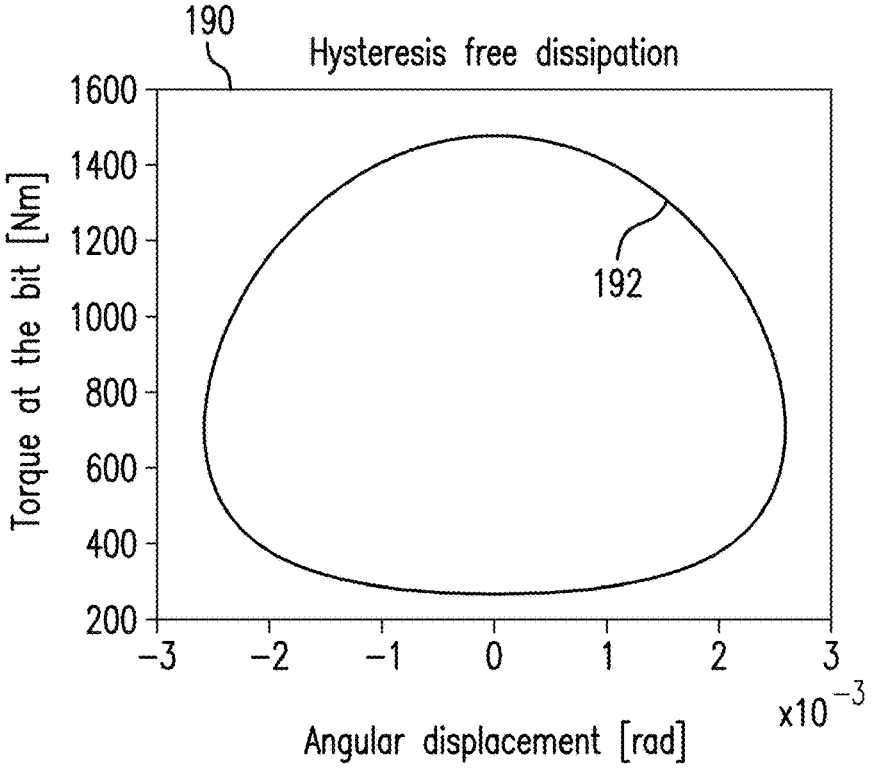
FIGS. 9A, 9B, 9C, and 9D show characteristic representations of the most important hysteresis curves that occur when energy is introduced into a high-frequency vibration of the drill.
Figure 9B:
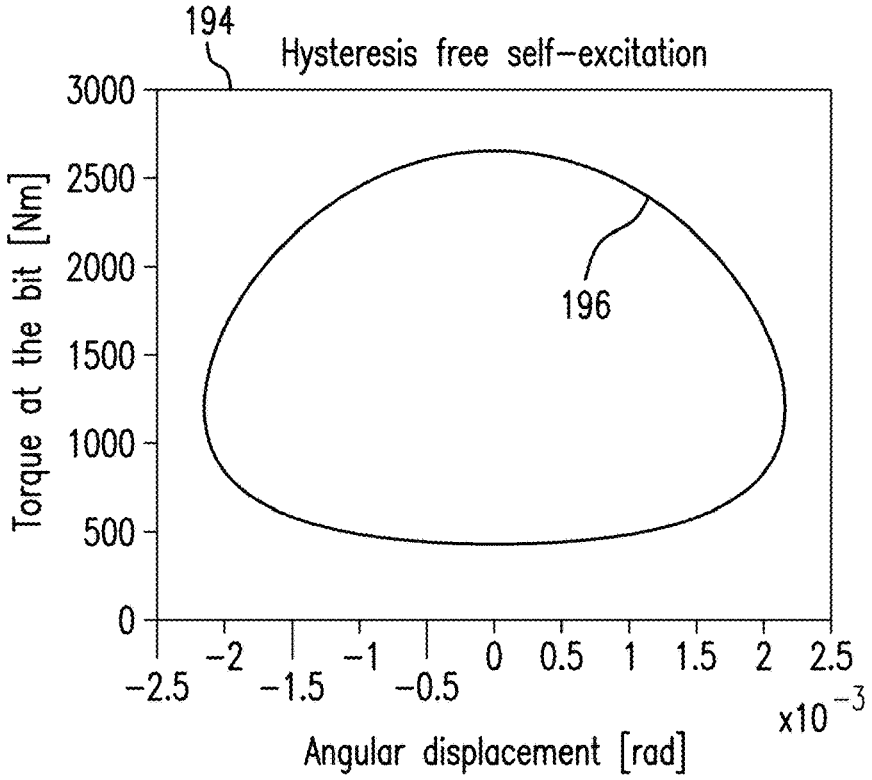
Figure 9C:
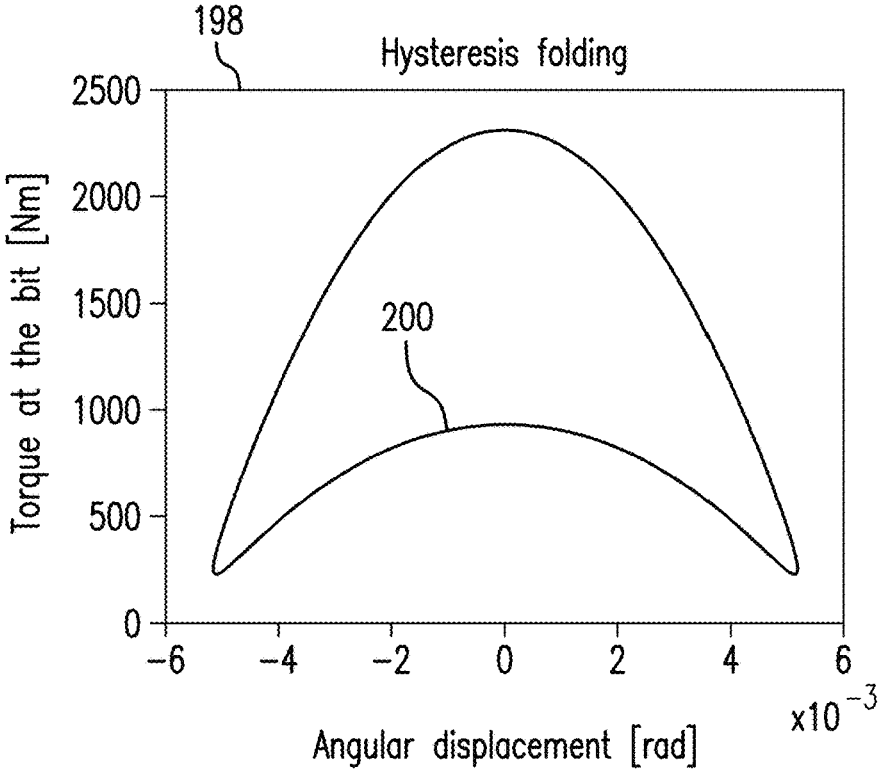
Figure 9D:
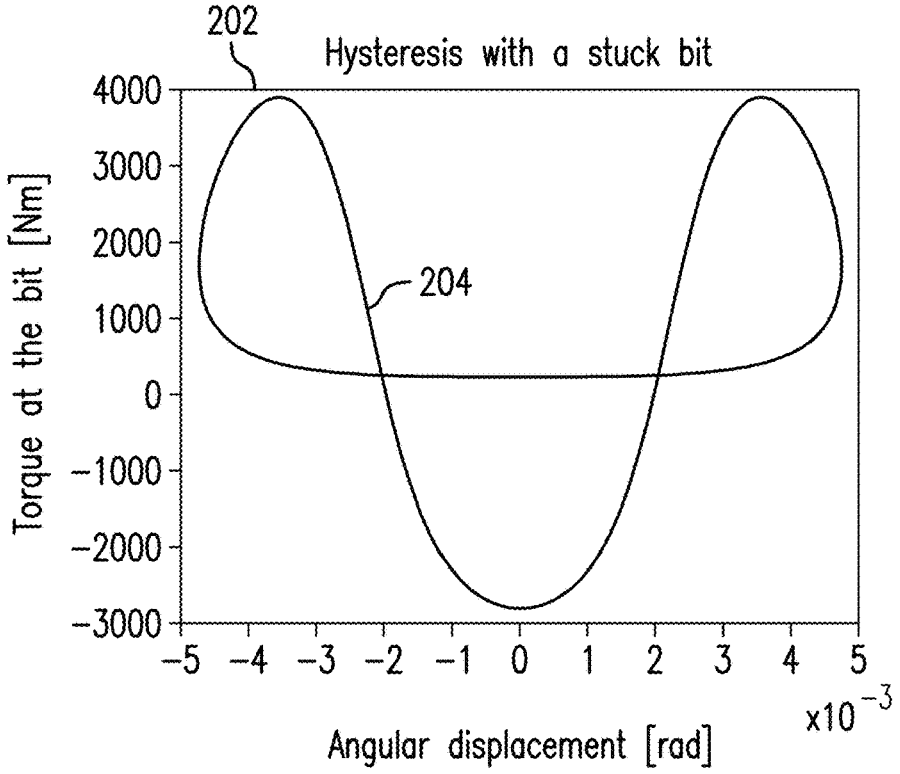

FIGS. 9A, 9B, 9C, and 9D (collectively referred to as FIG. 9) show examples of characteristic representations of the most important hysteresis curves that occur when energy is introduced into a high-frequency vibration of the drill. FIG. 9A is a graph 190 including a hysteresis curve 192, FIG. 9B is a graph 194 including a hysteresis curve 196, FIG. 9C is a graph 198 including a hysteresis curve 200, FIG. 9D is a graph 202 including a hysteresis curve 204.

With the information gained from the hysteresis curves, the amplitude of the HFTO oscillation (high-frequency oscillation) can now be taken into account as an additional parameter for determining the resistance characteristic curve.

Figure 10:
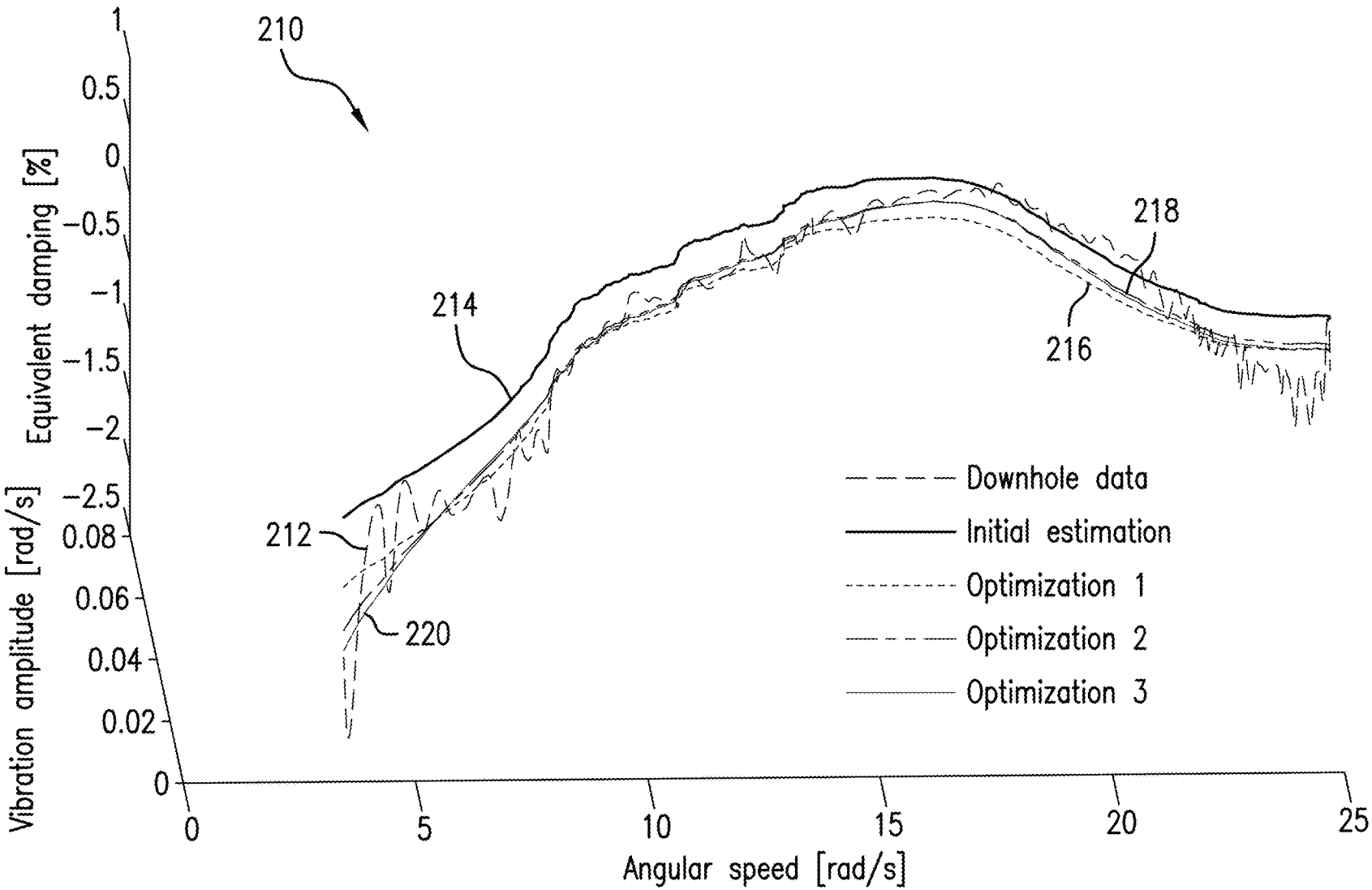
FIG. 10 depicts an example of effective/equivalent damping over low-frequency content of the angular velocity of a drill bit, and the amplitude of high-frequency content of the angular velocity.
Figure 11A:
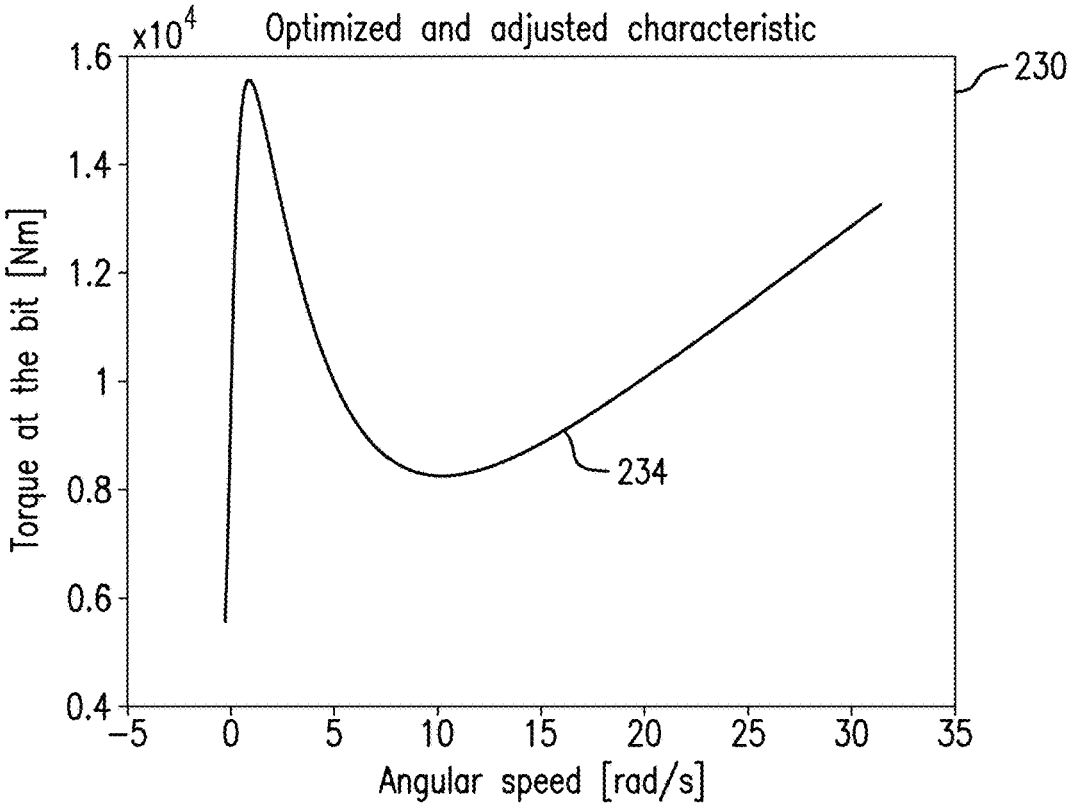
FIGS. 11A and 11B depict graphs showing an adjusted resistance characteristic curve.
Figure 11B:
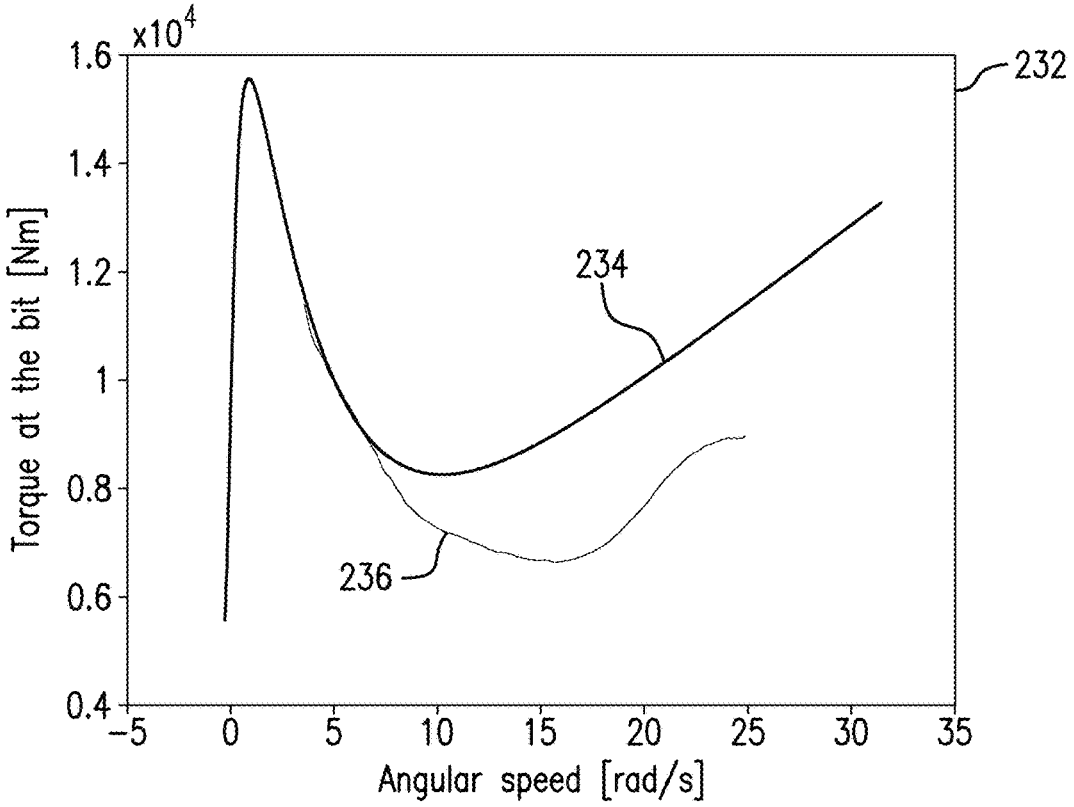

FIG. 10 Effective/Equivalent damping over low-frequency content of the angular velocity of the bit and the amplitude of the high-frequency content of the angular velocity of the HFTO oscillation for a constant WOB As shown in FIG. 10 (graph 210), the resistance characteristic curve can be adjusted to measured data 212 on the basis of an arbitrary resistance characteristic curve by means of optimization, e.g. smallest error squares. The sudden change in slope in the measurement data can still be seen in an initial estimation (curve 214) of the resistance characteristic curve FIG. 10, as well as in optimization curves 216, 218 and 220. FIGS. 11A and 11B include graphs 230 and 232, which show an optimized resistance characteristic curve 234 and a comparison of the adjusted (curve 234) and unadjusted resistance characteristic curve 236. Taking into account the other parameters (the amplitude of the HFTO oscillation), an adjusted resistance characteristic curve 234 in FIG. 11A can be determined. It can be seen that there is no sudden change in slope anymore, and that the minimum of the adjusted resistance characteristic curve 234 is at a lower angular velocity than the unadjusted resistance characteristic curve 236. The adjusted resistance characteristic curve is much more accurate than the unadjusted resistance characteristic curve that only considers WOB and angular velocity of the bit. FIG. 11B shows the difference between the adjusted and unadjusted resistance characteristic curves. Other parameters influencing the drilling process or the oscillation may also be taken into account.

The consideration of further parameters independent of angular velocity at the bit and WOB in the stability map leads to an extended stability map. Furthermore, in addition to the usual specifications in a stability map such as stable or unstable, the stability map can also be extended by specifying the effective damping or the amplitudes and intensities of the oscillation (high-frequency content).

Figure 12:
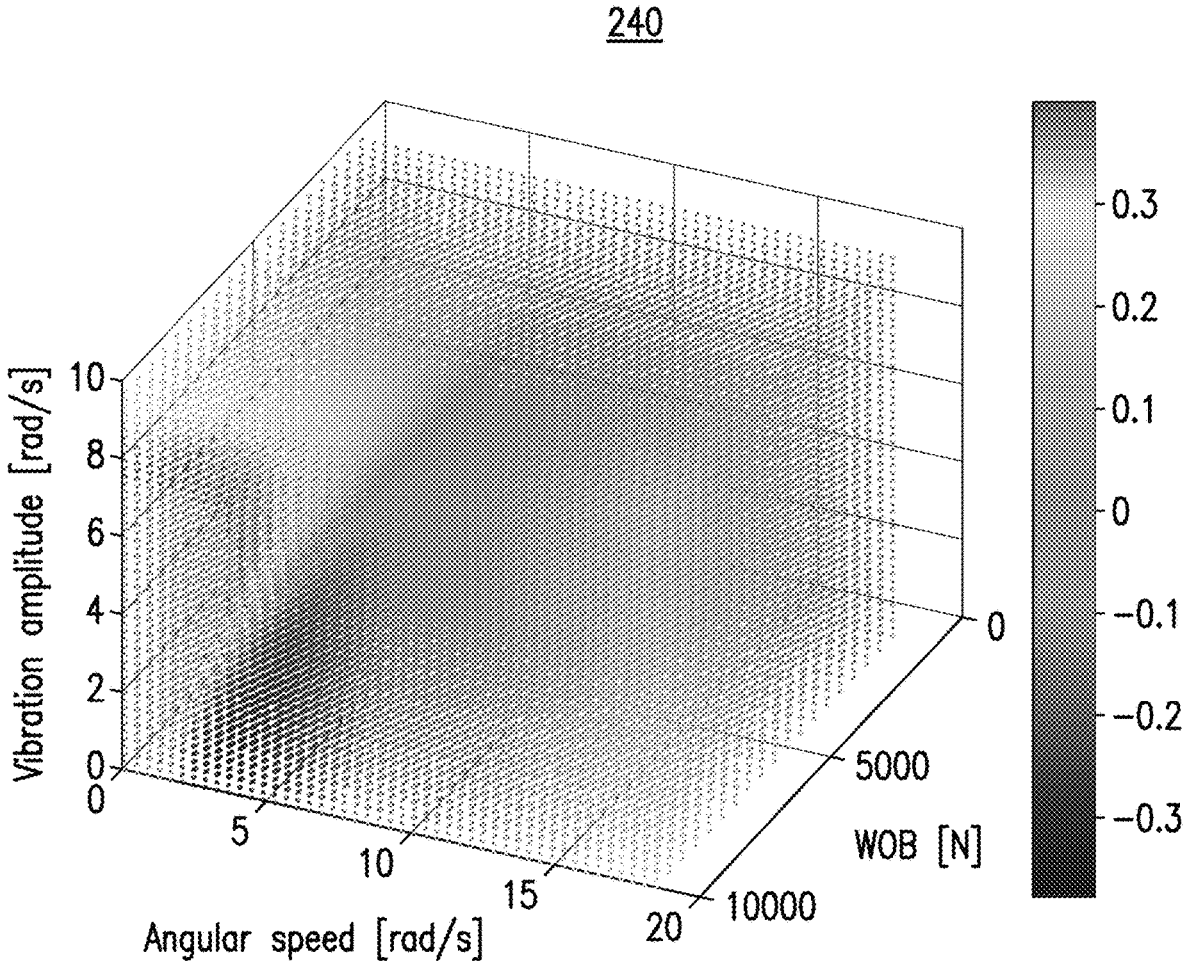
FIG. 12 depicts an example of a stability map (four dimensions of angular speed, WOB, amplitude of high-frequency oscillation, and equivalent damping).

FIG. 12 displays the angular velocity (RPM), WOB, the amplitude of the high-frequency oscillation, and the equivalent damping in an extended four-dimensional stability map 240.

A stability map may be 3-dimensional, as depicted in FIGS. 5 and 6 or 4-dimensional, as depicted in FIG. 12. A 4-dimensional stability map allows for displaying more than only stable or unstable regions. A 4-dimensional stability map allows for including the amplitude of oscillations (e.g. high-frequency content angular velocity) and/or the intensity of the oscillations in the stability map. In particular for the interaction of high and low-frequency content oscillations, the information on the amplitude and/or the intensity are very valuable, because it provides for an additional indication on how critical an oscillation is with respect to instability. An oscillation with a high amplitude but a rather small intensity may be less critical than an oscillation with a low amplitude but a high intensity (as depicted in FIG. 6).

Set forth below are some embodiments of the foregoing disclosure:

Embodiment 1

A method of estimating a stability value of a rotating downhole component, the method comprising: rotating the downhole component at a varying first rotary speed, the varying first speed having a plurality of first rotary speed values; identifying an oscillation of the downhole component; acquiring measurement data from a sensor, the measurement data indicative of a measured parameter related to the oscillation of the downhole component at the plurality of first rotary speed values; and estimating the stability value of the rotating downhole component as a function of an operational parameter based on the acquired measurement data.

Embodiment 2

The method as in any prior embodiment, further comprising calculating a resistance characteristic based on the acquired measurement data, the resistance characteristic being a function of an interaction between the downhole component and material in a subterranean region, and estimating the stability value based on the resistance characteristic.

Embodiment 3

The method as in any prior embodiment, further estimating a damping property based on the measurement data and estimating the stability value based on the damping property.

Embodiment 4

The method as in any prior embodiment, wherein the oscillation is a torsional oscillation.

Embodiment 5

The method as in any prior embodiment, wherein the downhole component has a second rotary speed associated with the oscillation of the downhole component, the second rotary speed varying over time, wherein a variation of the first rotary speed over time is smaller than a variation of the second rotary speed over time.

Embodiment 6

The method as in any prior embodiment, wherein the varying first rotary speed is associated with a low-frequency torsional oscillation, and the oscillation is associated with a high-frequency torsional oscillation.

Embodiment 7

The method as in any prior embodiment, wherein the downhole component has a second rotary speed associated with the oscillation of the downhole component, the second rotary speed varying over time, a variation of the first rotary speed comprising a first envelope, and a variation of the second rotary speed comprising a second envelope, wherein the second envelope is smaller than or equal to the first envelope.

Embodiment 8

The method as in any prior embodiment, wherein a frequency spectrum of the varying first rotary speed comprises a first maximum amplitude, and a frequency spectrum of the oscillation of the downhole component comprises a second maximum amplitude, wherein the first maximum amplitude appears at a lower frequency than the second maximum amplitude.

Embodiment 9

The method as in any prior embodiment, wherein calculating the resistance characteristic includes estimating an equivalent damping value (Deq).

Embodiment 10

The method as in any prior embodiment, wherein the resistance characteristic comprises at least one of a damping property, a coefficient of friction, and a torque at the bit.

Embodiment 11

The method as in any prior embodiment, further comprising controlling the operational parameter based on the estimated stability value.

Embodiment 12

The method as in any prior embodiment, wherein the rotating downhole component includes a component of a drill string.

Embodiment 13

The method as in any prior embodiment, wherein the oscillation includes a high-frequency torsional oscillation (HFTO) having a frequency, and the varying first rotary speed includes a stick-slip (SS) event, and acquiring the measurement data includes sampling a sensor at a sampling frequency that is greater than the frequency of the high-frequency torsional oscillation.

Embodiment 14

The method as in any prior embodiment, wherein the sampling frequency is bigger than 1000 Hz.

Embodiment 15

The method as in any prior embodiment, wherein estimating the stability value includes dividing the measurement data into dynamic measurement data and static measurement data, and estimating the damping property includes estimating an equivalent damping (Deq) based on the dynamic measurement data.

Embodiment 16

The method as in any prior embodiment, wherein the oscillation is a high-frequency torsional oscillation (HFTO) with an associated HFTO modal damping value DHFTO, and the resistance characteristic is a torque at the bit associated damping value Dc, the torque at the bit associated damping value Dc being equal to a sum of the equivalent damping value Dcq and the HFTO modal damping value DHFTO.

Embodiment 17

The method as in any prior embodiment, estimating the stability value includes generating a stability map, the stability map indicating stability values as a function of the operational parameter.

Embodiment 18

An apparatus for estimating a stability value of a rotating downhole component, the apparatus comprising: a sensor configured to generate measurement data indicative of a measured parameter related to an oscillation of the downhole component, the downhole component being rotated at a varying first rotary speed, the varying first rotary speed having a plurality of first rotary speed values; and a processor configured to acquire the measurement data and perform: identifying an oscillation of the downhole component; acquiring measurement data from the sensor, the measurement data indicative of a measured parameter related to the oscillation of the downhole component at the plurality of first rotary speed values; and estimating the stability value of the rotating downhole component as a function of an operational parameter based on the acquired measurement data.

Embodiment 19

The apparatus as in any prior embodiment, wherein the processor is further configured to perform: calculating a resistance characteristic based on the acquired measurement data, the resistance characteristic being a function of an interaction between the downhole component and material in a subterranean region, and estimating the stability value based on the resistance characteristic.

Embodiment 20

The apparatus as in any prior embodiment, wherein the processor is further configured to perform: estimating a damping property based on the measurement data and estimating the stability value based on the damping property.

In connection with the teachings herein, various analyses and/or analytical components may be used, including digital and/or analog subsystems. The system may have components such as a processor, storage media, memory, input, output, communications link (wired, wireless, pulsed mud, optical or other), user interfaces, software programs, signal processors and other such components (such as resistors, capacitors, inductors, etc.) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user, or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

What is claimed is:

1. A method of estimating a stability value of a rotating downhole component, the method comprising:

rotating the downhole component at a varying first rotary speed, the varying first rotary speed having a plurality of first rotary speed values;

identifying an oscillation of the downhole component;

acquiring measurement data from a sensor, the acquired measurement data indicative of a parameter related to the oscillation of the downhole component at the plurality of first rotary speed values; and estimating the stability value of the rotating downhole component as a function of an operational parameter based on the acquired measurement data, wherein the downhole component has a varying second rotary speed associated with the oscillation of the downhole component, wherein a variation of the varying first rotary speed over time is smaller than a variation of the varying second rotary speed over time.

2. The method of claim 1, further comprising calculating a resistance characteristic based on the acquired measurement data, the resistance characteristic being a function of an interaction between the downhole component and material in a subterranean region, and estimating the stability value based on the resistance characteristic.

3. The method of claim 2, wherein calculating the resistance characteristic includes estimating an equivalent damping value ($D_{eq}$).

4. The method of claim 3, wherein the oscillation of the downhole component is a high-frequency torsional oscillation (HFTO) with an associated HFTO modal damping value $D_{HFTO}$, and the resistance characteristic is a torque at the bit associated damping value $D_c$, the torque at the bit associated damping value $D_c$ being equal to a sum of the equivalent damping value $D_{eq}$ and the HFTO modal damping value $D_{HFTO}$.

5. The method of claim 2, wherein the resistance characteristic comprises at least one of a damping property, a coefficient of friction, and a torque at the bit.

6. The method of claim 1, further estimating a damping property based on the acquired measurement data and estimating the stability value based on the damping property.

7. The method of claim 6, wherein estimating the stability value includes dividing the acquired measurement data into dynamic measurement data and static measurement data, and estimating the damping property includes estimating an equivalent damping value ($D_{eq}$) based on the dynamic measurement data.

8. The method of claim 1, wherein the oscillation of the downhole component is a torsional oscillation.

9. The method of claim 1, wherein the varying first rotary speed is associated with a low-frequency torsional oscillation, and the oscillation of the downhole component is associated with a high-frequency torsional oscillation.

10. The method of claim 1, wherein the varying first rotary speed comprises a first envelope, and the varying second rotary speed comprises a second envelope, wherein the second envelope is smaller than or equal to the first envelope.

11. The method of claim 1, wherein a frequency spectrum of the varying first rotary speed comprises a first maximum amplitude, and a frequency spectrum of the oscillation of the downhole component comprises a second maximum amplitude, wherein the first maximum amplitude appears at a lower frequency than the second maximum amplitude.

12. The method of claim 1, further comprising controlling the operational parameter based on the estimated stability value.

13. The method of claim 1, wherein the rotating downhole component includes a component of a drill string.

14. The method of claim 1, wherein the oscillation of the downhole component includes a high-frequency torsional oscillation (HFTO) having a frequency, and the varying first rotary speed includes a stick-slip (SS) event, and acquiring the measurement data includes sampling the sensor at a sampling frequency that is greater than the frequency of the high-frequency torsional oscillation.

15. The method of claim 14, wherein the sampling frequency is bigger than 400 Hz.

16. The method of claim 1, wherein estimating the stability value includes generating a stability map, the stability map indicating stability values as a function of the operational parameter.

17. The method of claim 1, wherein the variation of the varying first rotary speed is a first angular acceleration of the downhole component, and the variation of the varying second rotary speed is a second angular acceleration of the downhole component.

18. The method of claim 1, further comprising using the estimated stability value while defining a design of a drill bit.

19. An apparatus for estimating a stability value of a rotating downhole component, the apparatus comprising:

a sensor configured to generate measurement data indicative of a parameter related to an oscillation of the downhole component, the downhole component being rotated at a varying first rotary speed, the varying first rotary speed having a plurality of first rotary speed values; and a processor configured to perform:

identifying the oscillation of the downhole component;

acquiring the measurement data from the sensor, the acquired measurement data indicative of the parameter related to the oscillation of the downhole component at the plurality of first rotary speed values; and estimating the stability value of the rotating downhole component as a function of an operational parameter based on the acquired measurement data, wherein the downhole component has a varying second rotary speed associated with the oscillation of the downhole component, wherein a variation of the varying first rotary speed over time is smaller than a variation of the varying second rotary speed over time.

20. The apparatus of claim 19, wherein the processor is further configured to perform: calculating a resistance characteristic based on the acquired measurement data, the resistance characteristic being a function of an interaction between the downhole component and material in a subterranean region, and estimating the stability value based on the resistance characteristic.

21. The apparatus of claim 19, wherein the processor is further configured to perform: estimating a damping property based on the acquired measurement data and estimating the stability value based on the damping property.

* * * * *